US005730494A

United States Patent [19]

LaPointe et al.

[11] Patent Number: 5,730,494

[45] Date of Patent: Mar. 24, 1998

[54] LINEAR ACTUATION DRIVE MECHANISM FOR POWER-ASSISTED CHAIRS

[75] Inventors: Larry P. LaPointe, Temperance; Ken K. Finzel, Monroe; Jonathan R. Saul, Erie; Karl J. Komorowski, Petersburg; Richard E. Marshall; Dennis W. Wright, both of Monroe, all of Mich.

[73] Assignee: La-Z-Boy Incorporated, Monroe, Mich.

[21] Appl. No.: 552,614

[22] Filed: Nov. 3, 1995

[51] Int. Cl.[6] ..... A47C 1/02

[52] U.S. Cl. ..... 297/330; 297/85; 297/330; 297/DIG. 10

[58] Field of Search ..... 297/DIG. 10, 85, 297/83, 330

[56] References Cited

U.S. PATENT DOCUMENTS

| | | | |
|---|---|---|---|
| 942,817 | 12/1909 | Flindall . | |
| 3,016,264 | 1/1962 | Hughes . | |
| 3,138,402 | 6/1964 | Heyl, Jr. et al. . | |
| 3,218,102 | 11/1965 | La Monte Specketer . | |
| 3,250,569 | 5/1966 | Gaffney . | |
| 3,343,871 | 9/1967 | Yates et al. . | |
| 3,588,170 | 6/1971 | Knabusch et al. . | |
| 3,596,991 | 8/1971 | Mckee . | |
| 3,848,845 | 11/1974 | Bogart . | |
| 3,851,917 | 12/1974 | Horstmann et al. . | |
| 3,934,929 | 1/1976 | Rabinowitz . | |
| 4,007,960 | 2/1977 | Gaffney . | |
| 4,231,614 | 11/1980 | Shaffer . | |
| 4,249,774 | 2/1981 | Andreasson | 297/311 |
| 4,365,836 | 12/1982 | Jackson et al. . | |
| 4,367,895 | 1/1983 | Pacitti et al. . | |
| 4,386,803 | 6/1983 | Gilderbloom . | |
| 4,453,766 | 6/1984 | DiVito . | |
| 4,722,566 | 2/1988 | Castellini . | |
| 4,786,107 | 11/1988 | Crockett . | |
| 4,946,222 | 8/1990 | Matson . | |
| 4,993,777 | 2/1991 | LaPointe . | |
| 5,061,010 | 10/1991 | LaPointe | 297/DIG. 10 X |
| 5,215,351 | 6/1993 | LaPointe | 297/DIG. 10 X |
| 5,271,660 | 12/1993 | La Pointe et al. | 297/95 |
| 5,314,238 | 5/1994 | Komrowski et al. | 297/DIG. 10 X |
| 5,427,431 | 6/1995 | Saul et al. | 297/85 |
| 5,466,046 | 11/1995 | Komorowski et al. | 297/DIG. 10 X |
| 5,482,350 | 1/1996 | Komorowski et al. | 297/DIG. 10 X |

*Primary Examiner*—Peter M. Cuomo
*Assistant Examiner*—Stephen Vu
*Attorney, Agent, or Firm*—Harness, Dickey & Pierce, P.L.C.

[57] ABSTRACT

A chair including a power-assisted linear actuation drive mechanism having a cam guide which is linearly movable upon rotation of a shaft for selectively actuating a lift and tilt linkage mechanism, and for causing forward lifting and tilting movement of the chair when a motor of the mechanism is operated in a first direction. Rotation of a shaft in a second opposite direction acts to lower the chair to a normal seating position. Continued rotation in the second direction causes a first cam block pivotably mounted to the cam guide to engage a first follower assembly for causing extension of a leg rest assembly and for causing a rearward tilt of the chair frame. Further rotation in the second direction causes a second cam block pivotably mounted to the cam guide to engage a second follower assembly for causing reclining movement of the chair and for causing an additional rearward tilt of the chair frame. This sequential operation of the leg rest assembly and the reclining linkage are independent and may be easily disabled to selectively eliminate either of the features.

25 Claims, 11 Drawing Sheets

FIG 1A
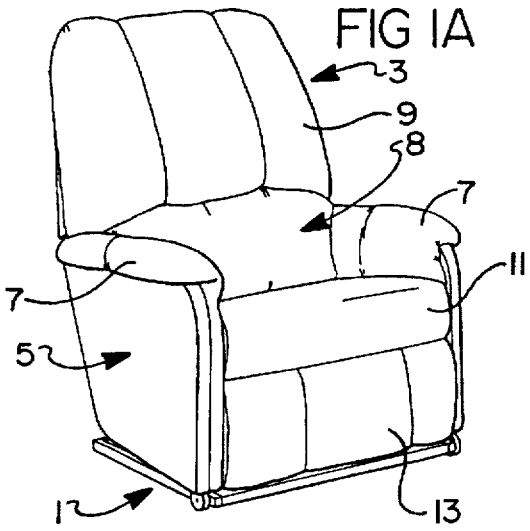
FIG 1B
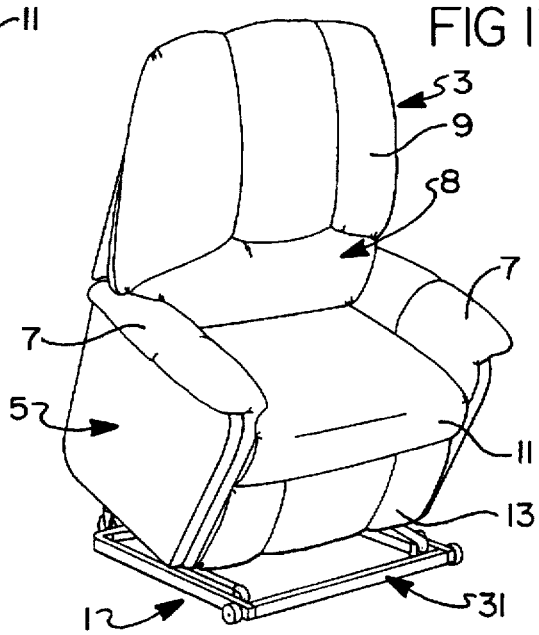
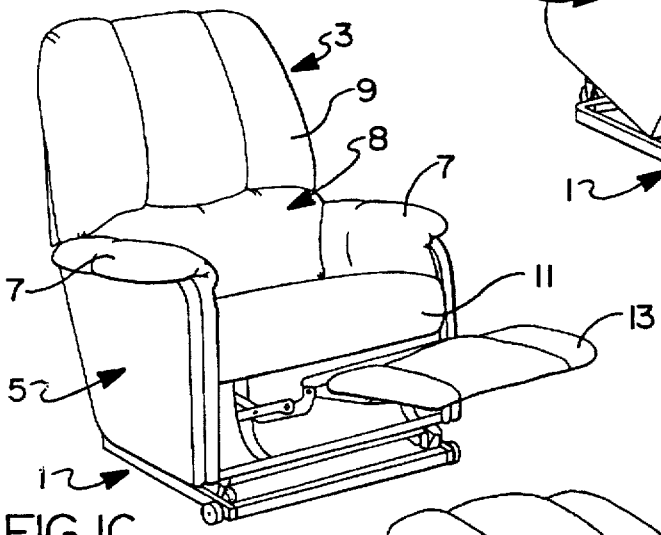
FIG 1C
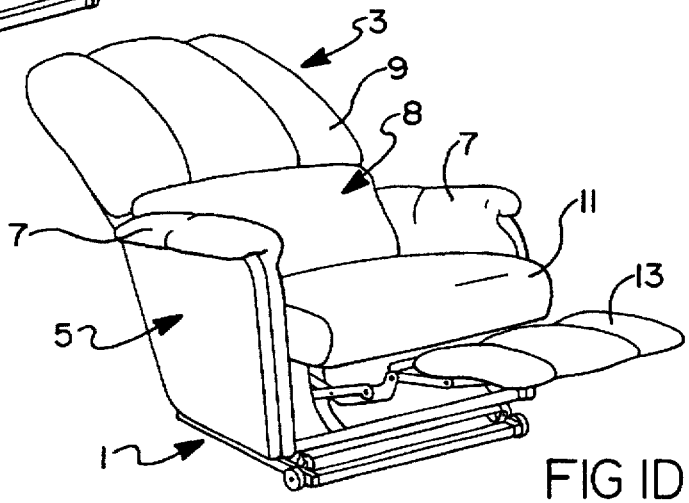
FIG 1D

FIG 6
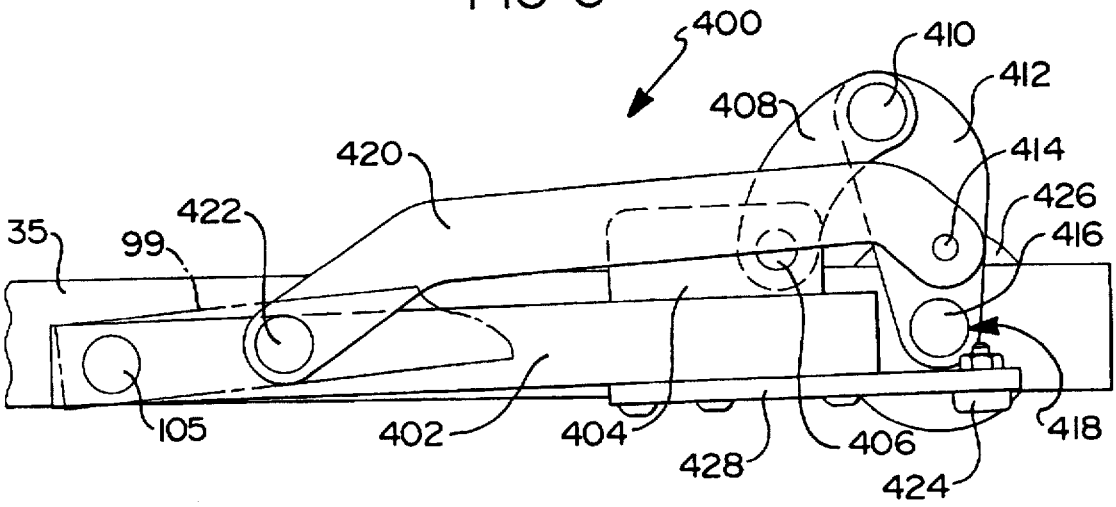
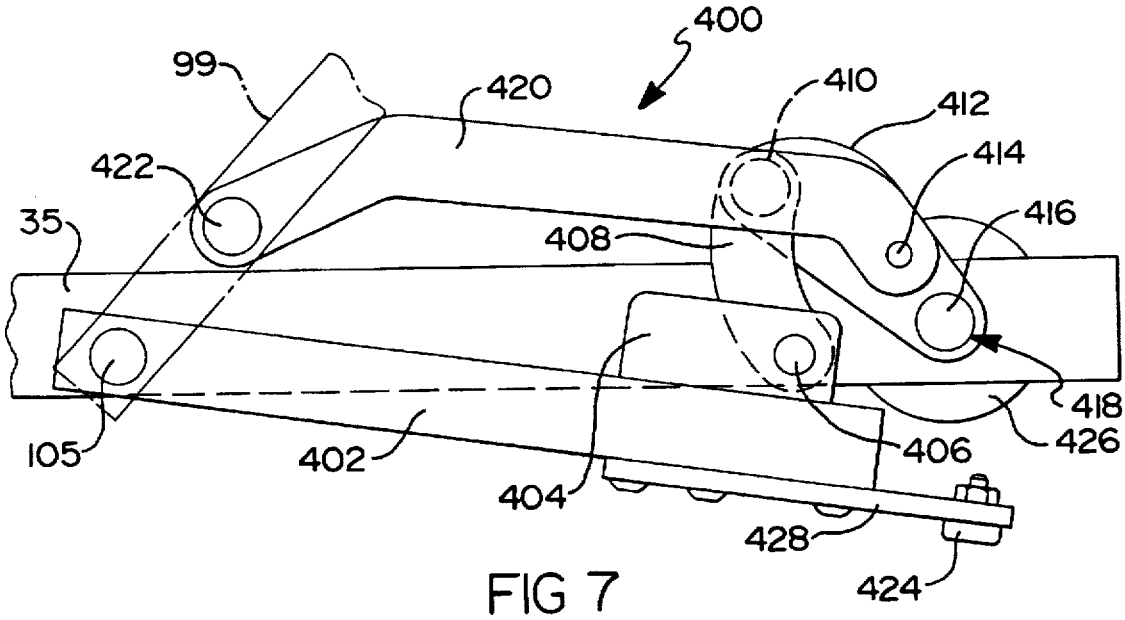
FIG 7

FIG 9
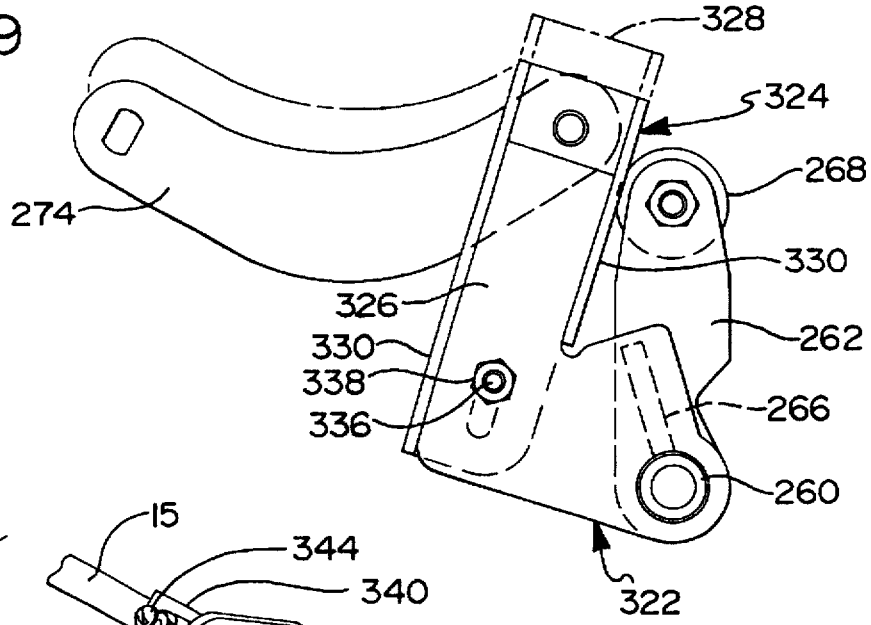
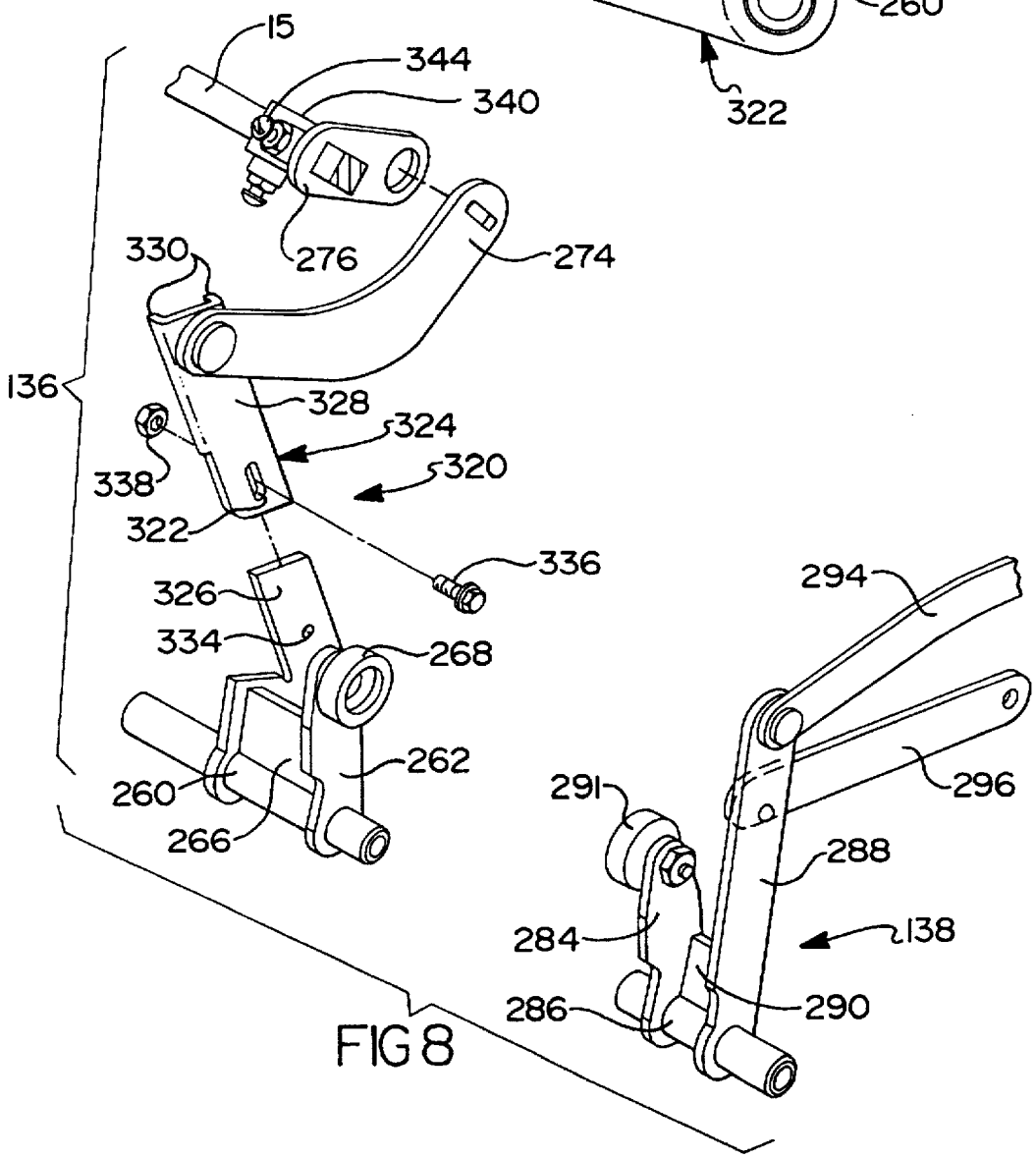
FIG 8

FIG 12B
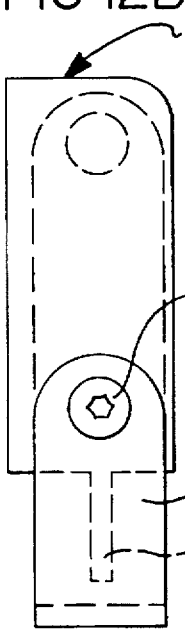
FIG 12A
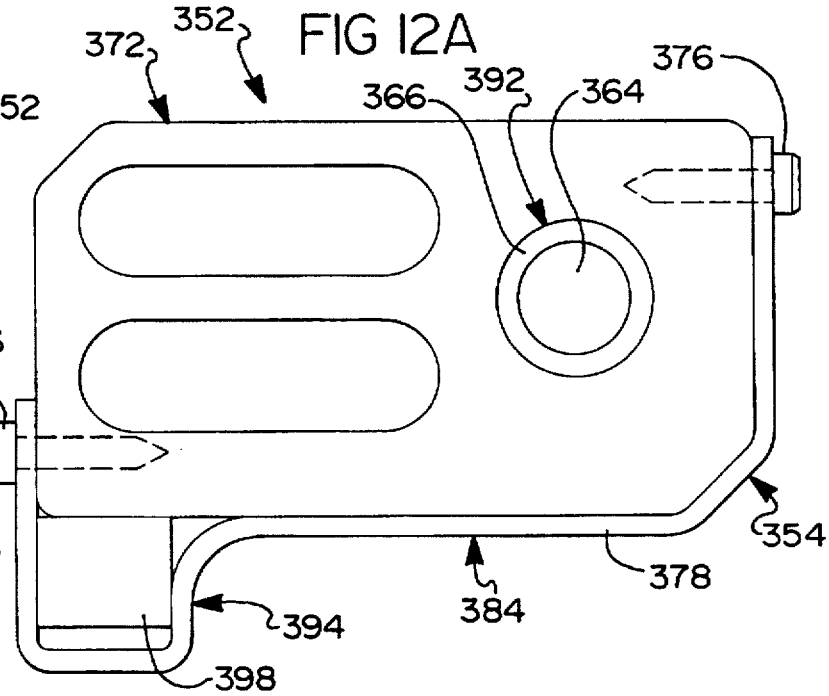
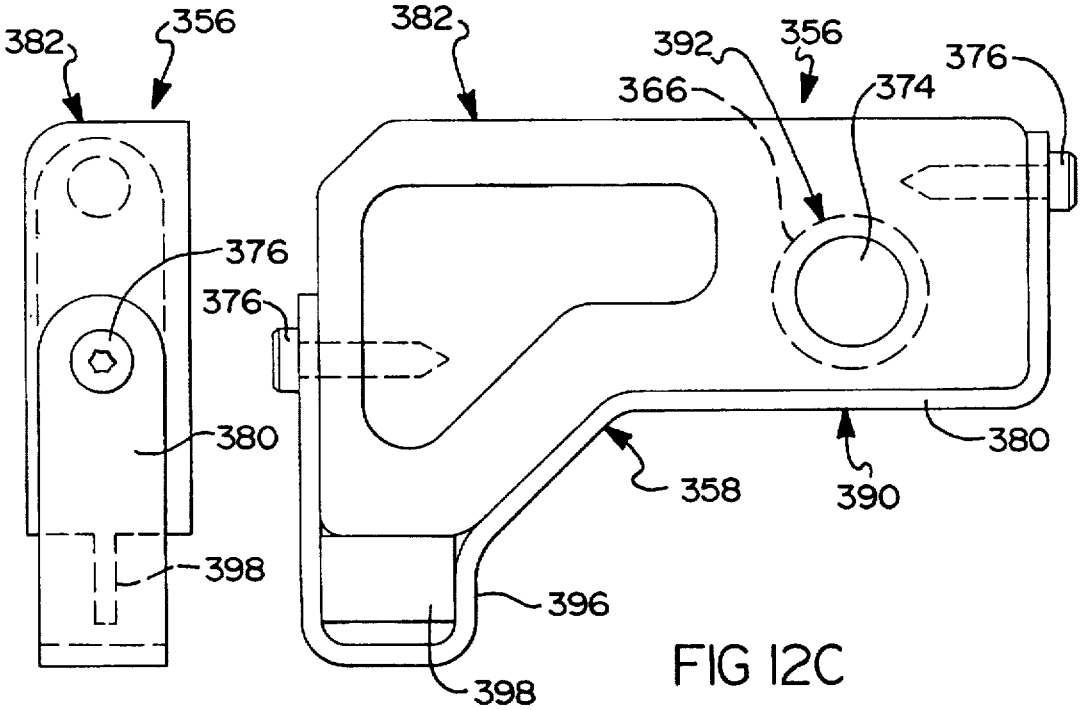
FIG 12C
FIG 12D

LINEAR ACTUATION DRIVE MECHANISM FOR POWER-ASSISTED CHAIRS

BACKGROUND OF THE INVENTION

1. Technical Field

The present invention relates generally to power-assisted articles of furniture and, more particularly, to a multi-function chair having a linear actuation drive mechanism selectively operable for lifting and tilting the chair, extending and retracting a leg rest assembly and reclining the chair between upright and fully reclined positions.

2. Discussion

Conventionally, power-assisted chairs typically include a motor-operated lift mechanism for aiding invalids and those persons requiring assistance in entering or exiting the chair. More particularly, motor-operated lift mechanisms are interconnected between a stationary base assembly and a moveable chair frame. An example of such a power-assisted chair is disclosed in commonly owned U.S. Pat. No. 4,993,777 which issued Feb. 19, 1991, and is entitled "Recliner Chair Lift Base Assembly".

Some power-assisted chairs also include separate linkage mechanisms for permitting the seat occupant to selectively actuate an extensible leg rest assembly and/or produce reclining angular movement of a seat assembly between "upright" and "reclined" positions. However, power-assisted chairs which provide such a multi-functional combination generally require the use of multiple motors for driving (i.e., pushing) the separate linkages which results in extremely large and expensive chair units yet still having limited reclining options. Moreover, such power-assisted chairs typically incorporate a drive mechanism which employs both a power "drive" function (i.e., for extending the leg rest, lifting the chair, and/or reclining the chair) and a power "return" function for returning the chair to the normal seated position.

SUMMARY OF THE INVENTION

Accordingly, the preferred embodiments of the present invention overcome the disadvantages associated with conventional power-assisted chairs by providing a single linear actuation drive mechanism that selectively and independently actuates a reclining linkage assembly and a leg rest linkage assembly, in addition to actuating a lift and tilt mechanism for raising, lowering and tilting the chair. Optionally, the leg rest assembly may be fully extended before actuation of the reclining assembly begins.

In a first preferred embodiment, the power-assisted linear actuation drive mechanism of the present invention includes a driven member which is linearly movable in response to rotation of a motor-driven shaft in a first direction for selectively actuating the lift and tilt mechanism for causing upward lifting and forward tilting movement of the chair. Thereafter, rotation of the motor-driven shaft in an opposite or second direction acts to lower the chair to the normal seating position. Continued rotation of the shaft in the second direction causes a pair of cams associated with the driven member to sequentially engage a first follower assembly for extending the leg rest assembly and a second follower assembly for causing angular reclining movement of the chair. The cams associated with the driven member may be arranged in such a manner that the reclining movement does not begin until the leg rest is fully extended. Moreover, such sequential actuation of the leg rest assembly and the reclining linkage assembly are independent and may be easily disabled to selectively eliminate either of the power-assisted features. In addition, the linear actuation drive mechanism of the present invention also includes an adjustable assembly for permitting precise calibration (i.e., setting) of the fully extended position for the leg rest assembly during final assembly of the power-assisted chair. Furthermore, the adjustable assembly is also adapted to facilitate in-service recalibration of the fully extended position for the leg rest assembly.

In an alternative preferred embodiment of the present invention the lift base assembly includes a novel enhancement provided by a pair of lift arms mounted to the front inner portion of the lower lift base, thereby providing additional vertical lift when the chair frame is raised forwardly to its "lifted" position. Each lift arm is coupled to the lift and tilt mechanism and raises the front portion of the lower lift base off of the front wheels as the chair frame moves into a forward and lifted position. Likewise, as the chair returns to a normal seated position the lift arms correspondingly return the lower lift base into a horizontal position and allow the front wheels to contact the floor. The addition of the lift arms raises the chair an additional 1.5 to 2 inches when the chair is in a lifted position without tipping the seat back of the chair past a substantially vertical orientation. Such additional lifting is achieved with the seat back having a normal seating angle when the chair is in its lowered position.

In another alternative preferred embodiment of the present invention the lift base assembly includes a number of novel enhancements such as a wheel mechanism further including a pair of wheels secured to a front portion of the lower lift base along with a pair of lockable casters which allow the lower lift base to be moved across the floor when the braking mechanism on the casters is disengaged. Likewise, when the braking mechanism is engaged, the lower lift base is prevented from sliding across the floor via the wheel mechanism. Thus, the combination of the front wheels and locking casters allow the seated occupant to be moved from one location to another while the chair is reclined and/or the leg rest is extended. Once the chair is positioned in the desired location, the casters may be locked to prevent the chair from moving.

The alternative preferred embodiment further incorporates novel reinforcing structure for strengthening various linkage members at their critical stress points. Each cam member has been provided with a metal wear plate for protecting each cam member engaging surface from damage due to excessive force created by each cam follower. The square drive rod has been reinforced by supports running from three separate locations on the chair frame to prevent the drive rod from deforming when excessive torque is applied. Numerous other structural improvements are also included to improve the overall strength and rigidity of the structure supporting and coupling the linear actuation drive mechanisms to the lift base assembly of the power-assisted chair.

The preferred embodiment of the present invention includes a novel tilting mechanism which allows for selectively changing the pitch of the chair frame. The tilting mechanism is responsive to movement of the linear actuation drive mechanism during the leg rest extension and reclining cycles of the chair. The tilting mechanism gradually provides approximately 7° of rearward pitch while the leg rest moves toward its fully extended position. Continued actuation of the drive mechanism causes the seatback of the chair to recline. During this reclining movement, the chair frame is provided with an additional approximately 3° of rearward pitch. The tilting mechanism has been uniquely designed so that the additional 3° of rearward pitch occurs early in the reclining cycle, allowing the seat occupant to adjust the rearward pitch of the chair with only a small change in the seatback angle. Thus, the occupant may rearwardly tilt the chair frame (with the leg rest fully extended) into a more supportive angle while leaving the seatback in a substantially upright position. This position is ideally suited for viewing television, eating or reading in a supportive yet relaxed posture.

The preferred embodiment of the present invention may be outfitted with a wooden seat frame that is designed to accommodate taller or larger occupants in a larger chair. It may also be fitted with a lower profile metal seat frame for shorter or smaller occupants. The metal seat frame provides a seating surface which is approximately 2 inches lower than that of the wooden seat frame. Such a metal seat frame is discussed and shown in U.S. patent application Ser. No. 08/319,672 filed Oct. 12, 1994, commonly owned by Applicant.

The motor assembly of the present invention is fully enclosed and all limit switches are contained within the rotatable member housing. A DC motor has been incorporated into the linear actuation drive mechanism which provides higher torque than is achievable with the AC motors. This feature allows use of a motor which can be used in a variety of countries which have different electrical power standards.

Other features and advantages of the present invention will become apparent upon consideration of the drawings and the description set forth hereinafter.

DESCRIPTION OF THE DRAWINGS

FIGS. 1A through 1D illustrate the various operative seating positions for a power-assisted in accordance with preferred embodiments of the present invention;

FIG. 6 illustrating the operative position of the reclining linkage assembly and base lift arm linkage assembly and the lift arm in its retracted position corresponding to a preferred embodiment of the present invention;

FIG. 7 illustrates the lift arm linkage assembly and the lift arm of FIG. 6 in its extended position;

FIG. 8 is an exploded perspective view showing a preferred construction for the follower assembly used to actuate the leg rest linkage assembly;

FIG. 9 is a side view of a portion of the leg rest follower assembly shown in FIG. 8 showing the leg rest follower assembly in assembled fashion;

FIG. 12A thorugh 12D illustrate the various surfaces and features of the leg rest cam block and the recliner cam block along with their associated wear plates according to the preferred embodiment of the present invention.

DETAILED DESCRIPTION OF THE PREFERRED EMBODIMENT

Figure 2A:
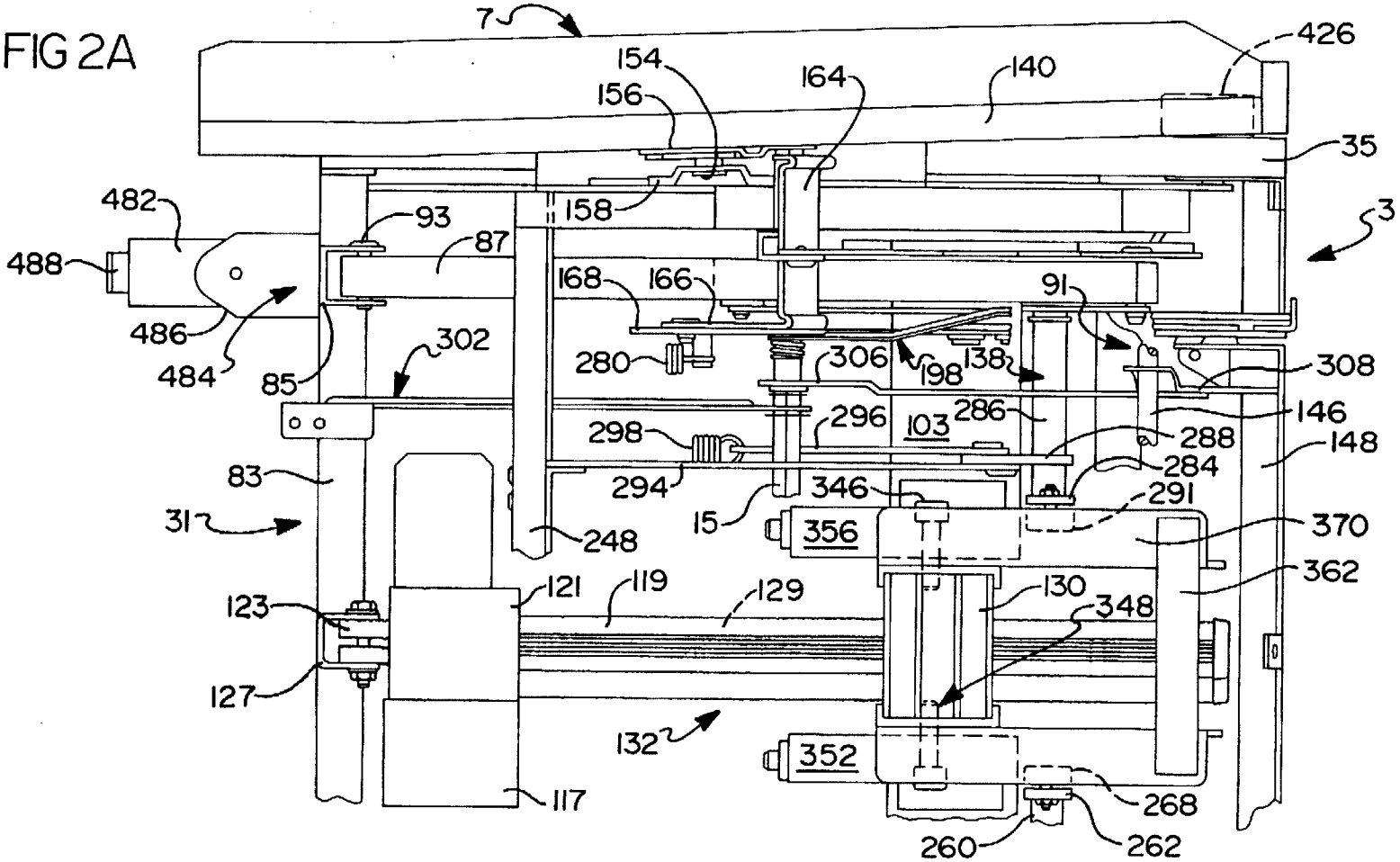
FIG. 2A is a plan view of a left-side portion of the chair frame, with its upholstery removed, illustrating the various components of a power-assisted linear actuation drive mechanism which is adapted to selectively actuate a lift and tilt mechanism, a reclining linkage assembly and a leg rest linkage assembly.

In general, the present invention is directed to a modified construction of a power lift chair and for the cam and follower arrangement disclosed in commonly owned U.S. Pat. No. 5,061,010 which issued Oct. 29, 1991, entitled "Cam Guide Drive Mechanism For Power-Assisted Chairs And The Like", the entire disclosure of which is expressly incorporated by reference herein. However, in order to provide a basis for one skilled in the art to understand the novelty of the inventive features to be hereinafter disclosed, the following discussion of the structure and function of a power-assisted chair constructed according to the preferred embodiments of the present invention is presented.

According to the present invention, a lift base assembly 1 is shown in FIGS. 1A through 1D supporting an upholstered chair 3 in various operative positions. While any of a wide variety of chair constructions can be used with lift base assembly 1, a well-known chair sold by the assignee hereof under the registered trademark RECLINA-REST® is an example of one type of chair that can be mounted on lift base assembly 1. In general, chair 3 has a frame 5 with side arms 7 and a seat assembly 8 supported from frame 5 and defined by a seat back 9 that may recline and a seat portion 11 that is constructed to move simultaneously with seat back 9. Chair 3 also includes an extensible leg rest assembly 13. Thus, FIG. 1A shows upholstered chair 3 in a "normal" seated or "upright" position. FIG. 1B illustrates chair 3 "lifted" to a forward-tilted position upon actuation of a lift and tilt mechanism for making it easier for a person to enter or exit chair 3. Next, FIG. 1C illustrates leg rest assembly 13 in a fully extended position with chair 3 maintained in the upright seated position. Finally, FIG. 1D illustrates chair 3 having seat assembly 8 angularly moved to a fully "reclined" position following extension of leg rest assembly 13.

Figure 2B:
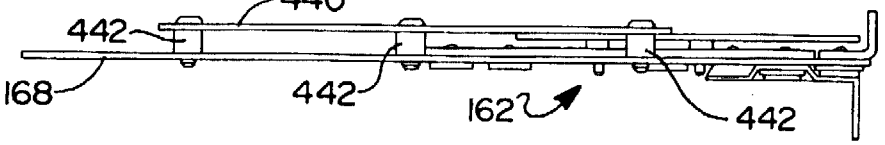
FIG. 2B is a plan view of the reinforced pantograph leg rest assembly in accordance with a preferred embodiment of the present invention.
Figure 3:
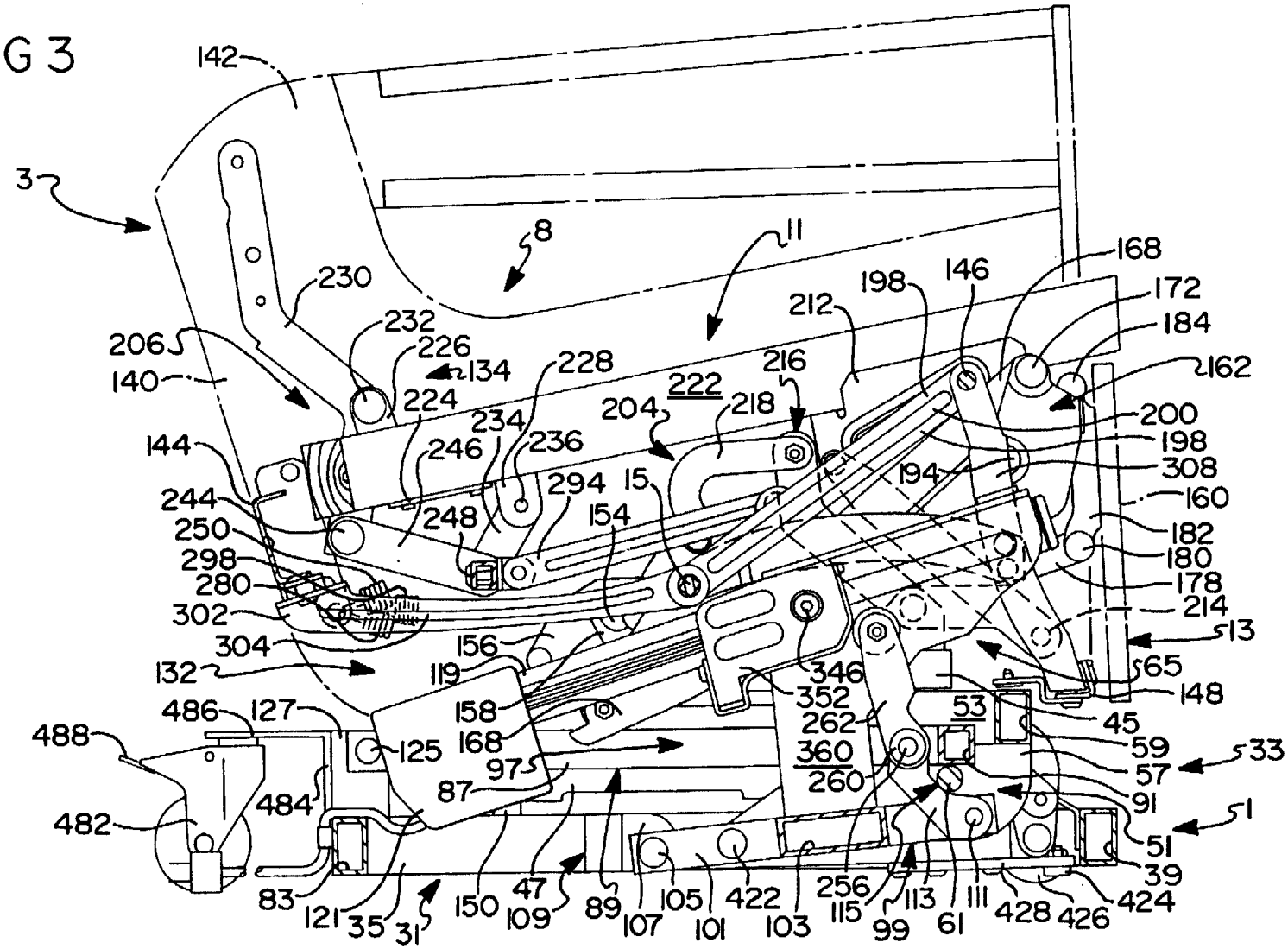
FIG. 3 is a side view of the linkage of the power-assisted chair shown in the position of FIG. 1A.

With particular reference to FIGS. 2 through 5, lift base assembly 1 is shown to have a stationary lower frame member 31 that rests on the floor and a movable upper frame member 33 on which chair 3 is removably but securely attached by suitable fasteners (not shown). Lower frame member 31 includes a pair of laterally-spaced metal side rails 35 that are rigidly secured to a metal front cross rail 39, and to a metal rear cross member 83. Upper frame member 33 has a pair of laterally-spaced metal side rails 45 that are rigidly interconnected to metal flange brackets 47 which engage both metal side rails 35 when chair 3 is in a normal seating position, as shown in FIG. 3. Soft rubber-like pads 50 secured to the bottom surface of metal flange brackets 47 are adapted to help transfer vertically-directed chair loads into bottom side rails 35 when chair 3 is in a non-lifted position. Thus, metal outer portions of lift base assembly 1 give the appearance of an ordinary chair base. However, the lift and tilt mechanism to be described nests inside of the metal frame members 31 and 33 and within chair frame 5 such that lift base assembly 1 is of a low profile and in most instances hidden from view.

The front of upper frame member 33 is reinforced by a U-shaped pivot bracket 51 having laterally-spaced side plates 53 (FIG. 4) that are securely affixed to the inside faces of metal side rails 45. In addition, the front ends of side plates 53 are rigidly secured to pivot plates 57 which extend below metal side rails 45 and into the confines of lower frame member 31, as seen in FIG. 3. As shown, pivot bracket 51 also includes a rectangular tube 59 that acts as a front cross piece between pivot plates 57, and which is made rigid therewith such as by welding. Furthermore, a tubular cross brace 61, located somewhat below and to the rear of front cross piece 59, also extends between pivot plates 57 and is likewise made rigid therewith, as by welding.

As best seen from FIG. 2, the opposite ends of metal rear cross member 83 terminate at the inboard side surface of side rails 35 and have a pair of U-shaped brackets 85 (only one being visible in FIG. 2) rigidly affixed along the top surface thereof in close proximity to side rails 35. Brackets 85 receive the rear ends of laterally-spaced upper tilt bar side legs 87 of a U-shaped upper tilt bar member 89, with front ends of side legs 87 being rigidly affixed, such as by welding, to opposite ends of a transversely extending front cross piece 91. More preferably, the rear ends of the upper tilt bar side legs 87 fit inside U-shaped brackets 85 on lower frame member 31 and are pivotally attached thereto, as indicated at pivot point 93. In addition, the upper or front ends of side legs 87 are pivotally attached to pivot plates 57 on upper frame member 33. As seen best in FIG. 3, the height of transverse rectangular tube 83 and U-shaped pivot bracket 85 is such that side legs 87 are substantially horizontal when lift base assembly 1 is in the fully lowered or seated position.

Upper tilt bar member 89 is part of a lift and tilt linkage mechanism 97 that is operably associated with base lift assembly 1. Lift and tilt linkage mechanism 97 also includes a lower lift bar member 99 having side legs 101 that are pivoted at their rear ends to a central portion of lower frame member 31 and at their forward ends to pivot plates 57 of upper frame member 33. More specifically, lower lift bar member 99 is substantially H-shaped and includes a pair of laterally-spaced side legs 101 that are spaced apart preferably the same amount as side legs 87 of upper tilt bar member 89, so as to be substantially coplanar therewith, though substantially shorter in length. A rigid rectangular tube 103 (shown in FIG. 3) extends between side legs 101 and is fixed thereto at central portions of side legs 1 01. The rearward ends of side legs 101 are pivotally attached at pivots 105 to side brackets 107 that are rigidly secured to the inside faces of lower frame member side rails 35, as indicated at 109. In addition, the upper and front ends of side legs 1 01 are pivotally attached to lower portions of pivot plates 57, as indicated at pivots 111. A pair of laterally-spaced reinforcement bars 113 are provided to maintain parallelism and are cutout at 115 so that they can pass close to the rear of cross brace tube 61. As seen best in FIG. 3, the various parts of upper tilt bar member 89 and lower lift bar member 99 associated with lift and tilt linkage mechanism 97 are confined within upper and lower frame members 33 and 31, respectively, when lift base assembly 1 is in the lowered or normal seating position. Thus, lift and tilt mechanism 97 is constructed to have an operably low profile and be compact in nature.

Referring now to FIGS. 6 and 7, lower frame member 31 also includes a pair of lift arm linkage assemblies 400 which provide additional lift of lower frame member 31 when chair 3 is "lifted" to a forward tilted position as illustrated in FIG. 1B. Each lift arm linkage assembly 400 is positioned in a parallel fashion along the inboard surface of each side rail 35. It is to be understood that lift arm linkage assemblies 400 are attached to both inboard surfaces of each side rail 35 but since both are exactly alike, only one will be described with significant detail.

Lift arm linkage 400 is more particularly defined by lift arm tube 402 having an aperture formed at its rear portion for attachment to pivot 105 and a lift link 404 securely attached to a front portion along the top surface of lift arm tube 402. Each lift arm tube 402 has secured to its underside an extension plate 428 having a suitable scuff-resistant glide 424 secured to a bottom surface thereof which engages the floor. A connecting link 408 is attached to lift link 404 at pivot 406, and is also attached at its opposite end to L-shaped toggle link 412 at pivot 410. Each toggle link 412 attaches to an inside surface of lower side rail 35 at pivot 416. Pivot 416 is secured to lower side rail 35 by pivot pin 41 8, which is the same pin that secures front wheel 426 to the front outboard side of lower side rail 35. Toggle link 412 is further connected to control link 420 at pivot 414 located proximately above pivot 416. Control link 420 is further connected to side leg 1 01 of lift bar member 99 at pivot 422. Referring briefly to FIG. 7, as lift bar member 99 rotates counterclockwise about pivot 105, lift arm linkage 400 forces each lift arm tube 402 to rotate arcuately downward (i.e., clockwise) about pivot 105 in an opposite direction, thereby providing additional vertical lift of lower frame member 31 as control link 420 is drawn toward a rear portion of lower frame member 31 by lift bar member 99. The lift arm linkage assemblies 400 lift the base I off the front wheels 426 thereby preventing the base from rolling for added stability when the chair 3 is in its raised position. Accordingly, the extension plates 428 and scuff-resistant glides 424 of lift arm linkage assemblies 400 prevent the chair 3 from rolling on front wheels 426 while in the raised position. Lift arm linkage assemblies 400 also provide an additional 1.5 to 2 inches of lift when the chair 3 is in its lifted position. Such additional lifting is accomplished without tipping the seat back 9 beyond a generally vertically oriented position when the chair 3 is fully raised, and yet permits the seat back 9 to have a normal seating angle when the chair 3 is in its normal lowered position. Additionally, extension plates 428 move guides 424 forward of lift arm 402 to provide a more stable support base.

The rear portion of lower frame member 31 also includes a pair of casters 482 which are secured to L-shaped caster brackets 484. Each caster bracket 484 is securely affixed to the rear surface of U-shaped pivot brackets 85 and metal rear cross member 83 and extends in a perpendicular fashion from the rear face of rear cross member 83 away from the rear portion of lower frame member 31. Caster brackets 484 are designed to be used in two different mounting positions. As most clearly seen in FIGS. 3 and 4, caster brackets 484 are mounted with rearward facing flanges 486 up so that casters 482 can be secured thereto. FIG. 5 best illustrates caster brackets 484 mounted with rearward facing flanges 486 down. This alternative configuration allows scuff-resistant glides 424 to be attached to flanges 486 thereby replacing casters 482. Additionally, casters 482 are provided with a locking mechanism which can be activated by locking lever 488. Engaging locking lever 488 into its lowered position stops all movement by braking the caster wheels and preventing the casters from rotating about their mounting bracket. Returning locking lever 488 into its raised position allows casters 482 to freely move.

When locking lever 488 is placed into its raised position, lower frame member 31 is able to move across the floor via front wheels 426 and casters 482. Moving locking lever 488 into its lowered engaged position causes a braking action which prevents lower frame member 31 from moving across the floor via front wheels 426 or casters 482.

In accordance with a preferred construction for lift base assembly 1, a power-assist mechanism is operably connected to lower lift bar member 99 for arcuately pivoting it up or down about pivots 105 and, thereby for operatively driving lift and tilt mechanism 97. With specific reference to FIGS. 2–5, the power-assist arrangement includes an electric motor, preferably, but not limited to, a DC powered motor 121 which drives a screw shaft 129 (not shown) contained within motor housing 119, as motor 121 rotates in either a first or second direction. The maximum range of motion of cam guide 130 is controlled by limit switches (not shown) contained within motor housing 119. Motor 121 may also be used in conjunction with a battery system 117, which is contained within or appurtenant to motor housing 119. In cases of a power failure, battery system 117 may operate as a backup power source which allows the chair to be lifted and tilted at least once so that the occupant may exit from the chair. Additionally, battery system 117 may be designed to allow the chair to be cycled multiple times before recharging. Thus, a mobile power lift chair is provided which may operate independently of a fixed electrical outlet power source allowing the occupant to be wheeled to a location without an electrical outlet. Battery system 117 can then be trickle charged when the chair is connected to an AC power source. Motor 121 is provided with a flange 123 which extends rearwardly through motor housing 119, and fits between and is pivotally attached at pivot 125 to opposite sides of a U-shaped pivot bracket 127 that is secured to a central portion of rear cross member 83 of lower frame member 31. A suitable assembly of motor 121, housing 119, shaft 129 and cam guide 130 is available as the OKIDRIVE+1 manufactured by Okin of Germany. However, one skilled in the art will appreciate that other suitable motor assemblies may be used to accomplish the same function. Rear cross member 83 is further secured to side mils 35 by welding the members together. Motor 121 is selectively operable for retracting or extending cam guide 130 in either of a first or second direction (respectively). Both motor 121 and shaft 129, contained within motor housing 119, are operable to arcuately swing up and down in a generally vertical plane about pivot 125. While no attempt is made to limit the specific control system for motor 121, reference can be made to U.S. Pat. No. 5,061,010, the disclosure of which is hereby incorporated by reference, for a complete description of a suitable electrical control system as well as the structure of a suitable hand-operated control device for selectively controlling the direction of rotation of shaft 129.

With particular reference to FIGS. 3 through 8, the power-assist arrangement of the present invention is shown to also include a linear actuation drive mechanism 132 that is adapted to selectively actuate a reclining linkage assembly 134, leg rest assembly 13, reclining tilt assembly 65, and lift and tilt mechanism 97 in response to energization of motor 121. In general, linear actuation drive mechanism 132 is operable for sequentially and independently actuating leg rest assembly 13 and reclining linkage assembly 134 utilizing a single electric motor 121 and a driven member, hereinafter referred to as cam guide 130.

Figure 11:
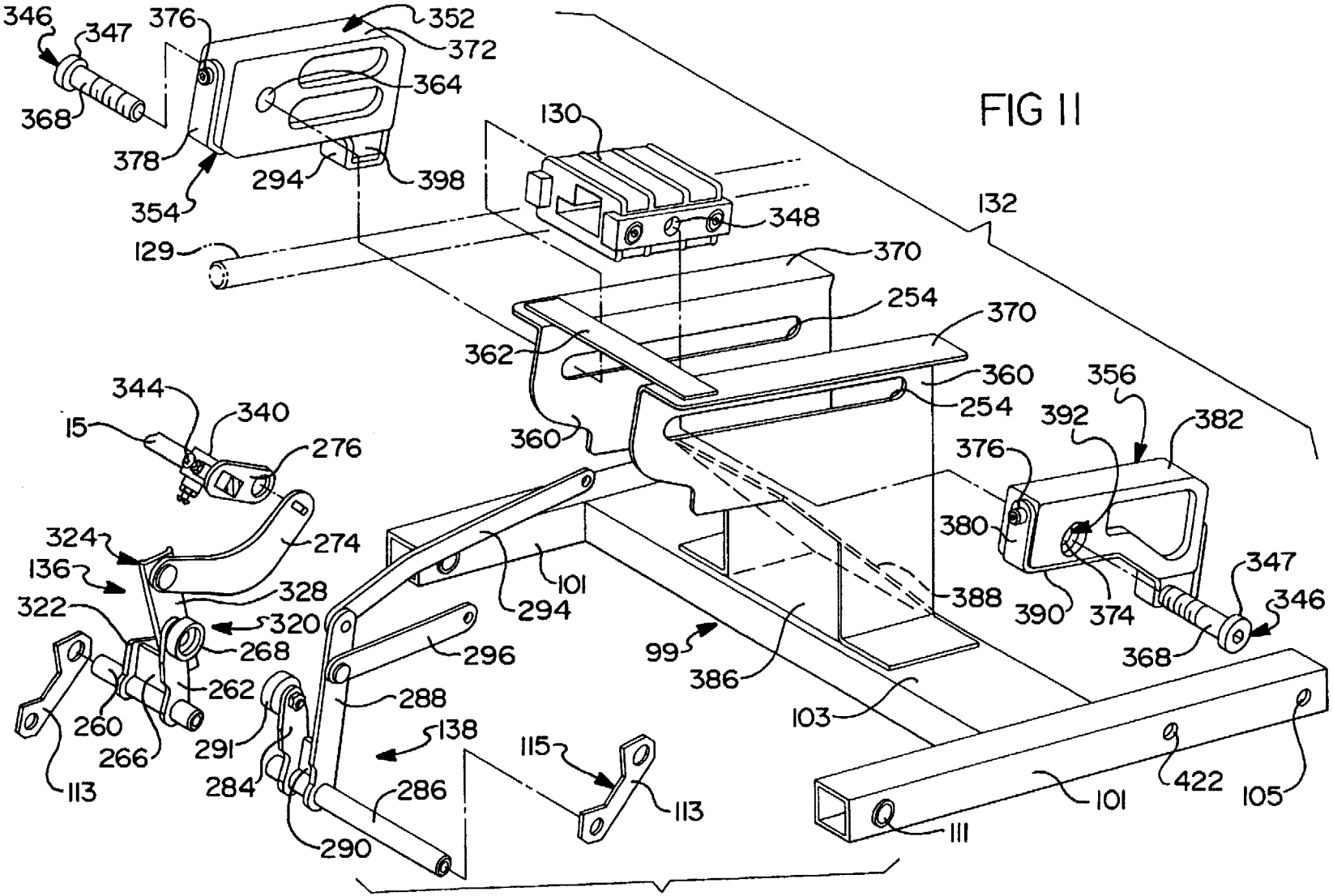
FIG. 11 is an exploded perspective view of the various components associated with the linear actuation drive mechanism shown in FIG. 2.

Referring specifically to FIGS. 2 and 11, cam guide 130 comprises a rectangular block encompassing housing 119, and having teeth (not shown) on opposing sides of its inner walls which engage threads formed along shaft 129. Cam guide 130 further comprises a pair of cam guide pins 346 for securing cam blocks 352 and 356 to cam guide 130, and for maintaining alignment with slots 254 formed in L-shaped pivot brackets 360. Guide pins 346 are secured within threaded bores formed within cam guide 130. As will be described, shaft 129 selectively rotates within motor housing 119 such that cam guide 130 moves forwardly or rearwardly along shaft 129 upon driven rotation of motor 121 in one of the first and second directions. Cam guide 130 maintains constant alignment with housing 119 by engaging slots running the length of housing 119. More specifically, cam guide 130 is adapted to move linearly along shaft 129 for sequentially engaging and driving a leg rest follower assembly 136 and a recliner follower assembly 138 which, in turn, are operatively coupled to leg rest assembly 13 and reclining linkage 134, respectively. As will be appreciated, the use of a single power-assisted drive system, such as linear actuation drive mechanism 132, provides for selectively lifting and tilting chair 3 (via lift and tilt mechanism 97), extending and retracting leg rest assembly 13 (via leg rest follower assembly 136), angularly moving seat back 9 and seat 11 of seat assembly 8 between an "upright" and a "reclined" position (via recliner follower assembly 138), and rearwardly tilting chair 3 (via tilt control assembly 204).

Referring again to FIGS. 2–5, chair frame 5 includes left and right side panels 140 (only one being visible in FIG. 2) having rearwardly sloping uprights 142 with side panels 140 being interconnected by a rear cross member 144 and front top support rod 146 and bottom transverse cross rails 148, respectively, and which are joined together by bracket plates 150. Bracket plates 150 are secured directly to a front portion of side panels 140. As best seen from FIGS. 2 and 5, chair frame 5 is mounted outside and generally on top of lift base assembly 1 and is pivotally secured thereto about a pivot 154 between a bracket 156 fixed to an inner wall of chair frame side members 140 and a second bracket 158 secured to an upper surface of side members 45 of upper frame member 33. In addition, a leg rest board or panel 160 (FIG. 3) is supported upon chair frame 5 by a pair of extensible pantograph leg rest linkage assemblies 162, an example of which is clearly illustrated and described in the U.S. Pat. No. 3,588,170 to E. M. Knabusch et al., issued Jun. 28, 1971 for "Motor-Operated Reclining Chair", the specification and drawings of which are expressly incorporated by reference herein. It is to be understood that pantograph linkages 162 are applied to both lateral sides of chair frame 5 but since both are exactly alike, only one will be described herein.

Figure 10A:
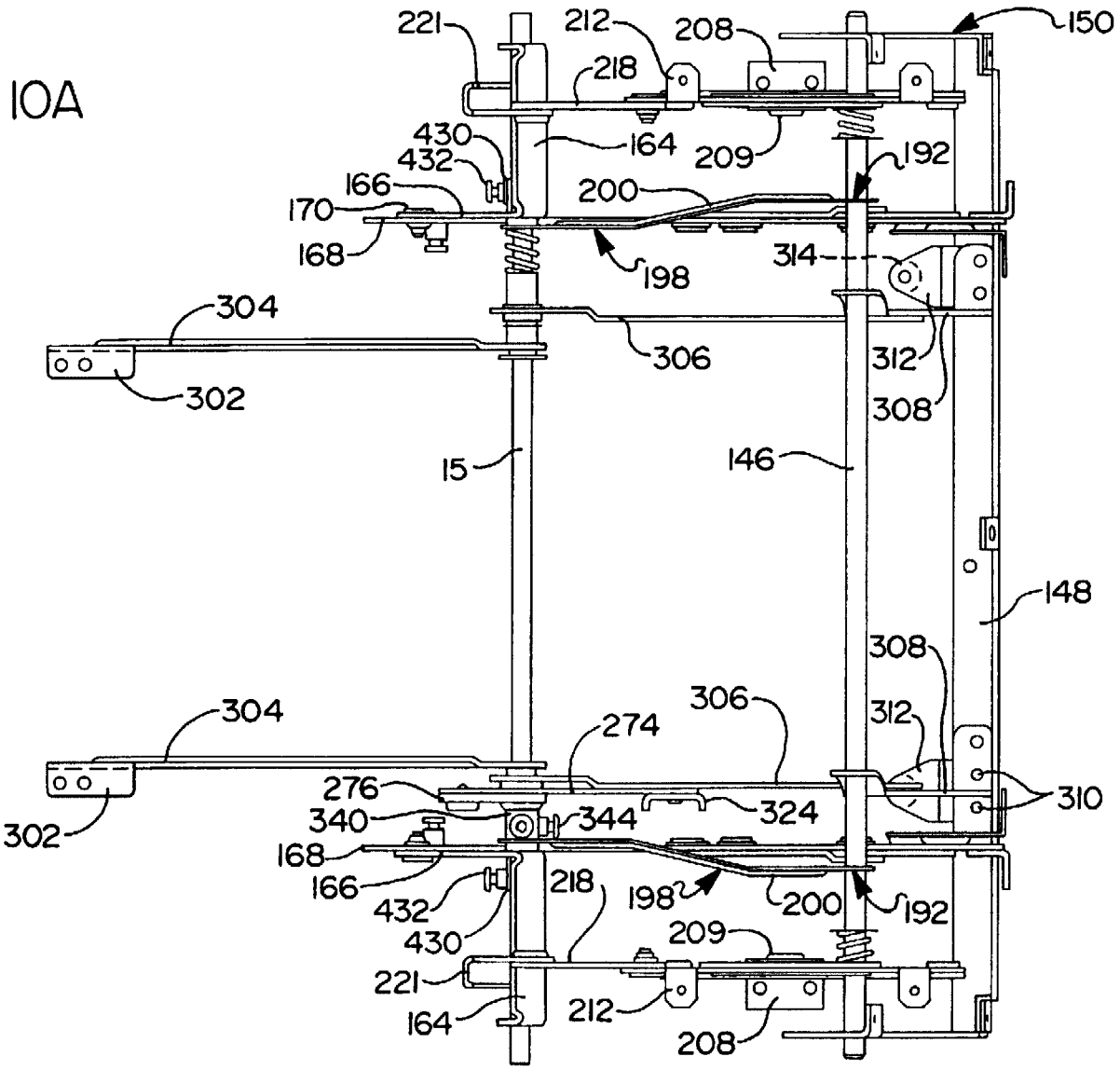
FIG. 10A is a plan view illustrating the construction of various reinforcement linkage members attached to the square drive shaft according to therefor preferred embodiment of the present invention.
Figure 10B:
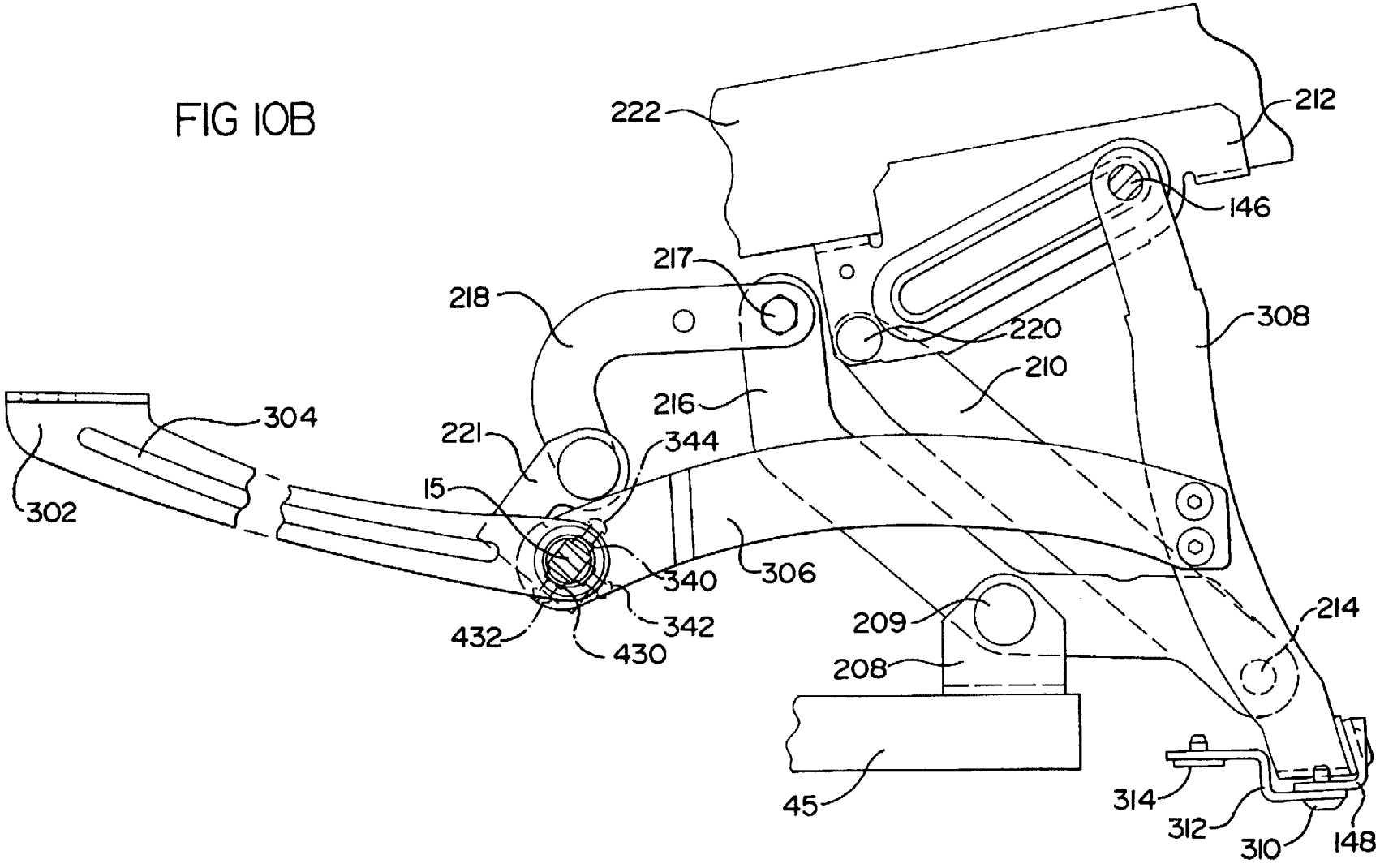
FIG. 10B is a side view of FIG. 10A particularly illustrating the tilt control linkage according to the preferred embodiment of the present invention.

As is generally known, pantograph linkages 162 are operably suspended from a square drive shaft 15 which extends transversely to chair frame 5 and is supported between chair frame side members 140 for rotational movement relative thereto. Pantograph linkages 162 are further supported from top support rod 146 which also extends transversely to chair frame 5 between bracket plates 150. Support rod 146 also provides for rotational movement of pantograph linkages 162 thereto. Referring briefly to FIG. 10 an L-shaped drive bracket 164 is coupled for rotation with drive shaft 15 and includes a down-turned operating arm 166. Drive bracket 164 further includes square reinforcing sleeve 430 secured (i.e. welded) to the down-turned operating arm 166 at the inboard face of drive bracket 164, and is aligned with a square aperture (not shown) formed in drive bracket 164 and through which drive shaft 15 extends. A pair of set screws 432 are retained within threaded bores formed through square reinforcing sleeve 430 and which are adapted to lockingly engage an outer surface of drive shaft 15 for fixing the orientation of drive bracket 164 relative to drive shaft 15. Square reinforcing sleeve 430 provides drive bracket 164 with additional load bearing strength. An actuating or long drive link 168 (FIGS. 4 and 5) of pantograph linkage 162 is pivotally secured about a pivot 170 (FIG. 4) to a lower end of arm 166, with the opposite end of drive link 168 being pivotally secured about a pivot 172 to a link 174. As best seen in FIG. 2, long drive link 168 is provided with additional strength by reinforcing link 440 running the length of long drive link 168 and secured to long drive link 168 with three spacer rivets 442 at predetermined locations. Reinforcing link 440 further stiffens and prevents structural failure of long drive link 168 when excessive loads are placed upon leg rest assembly 13.

Figure 4:
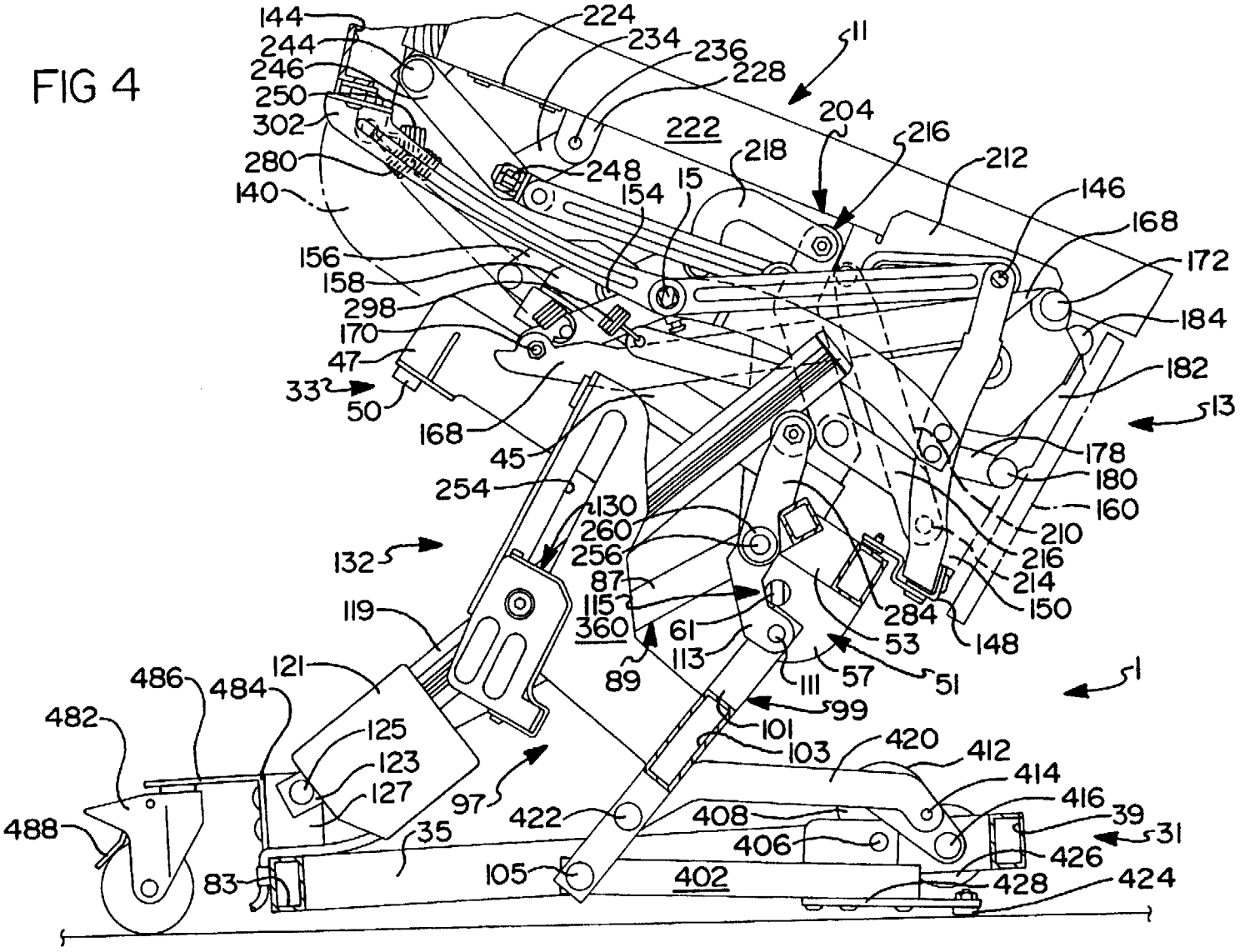
FIG. 4 is a side view of the linkage of the power-assisted chair shown in FIG. 1B showing the orientation of the individual linkage components with the chair in an elevated position.
Figure 5:
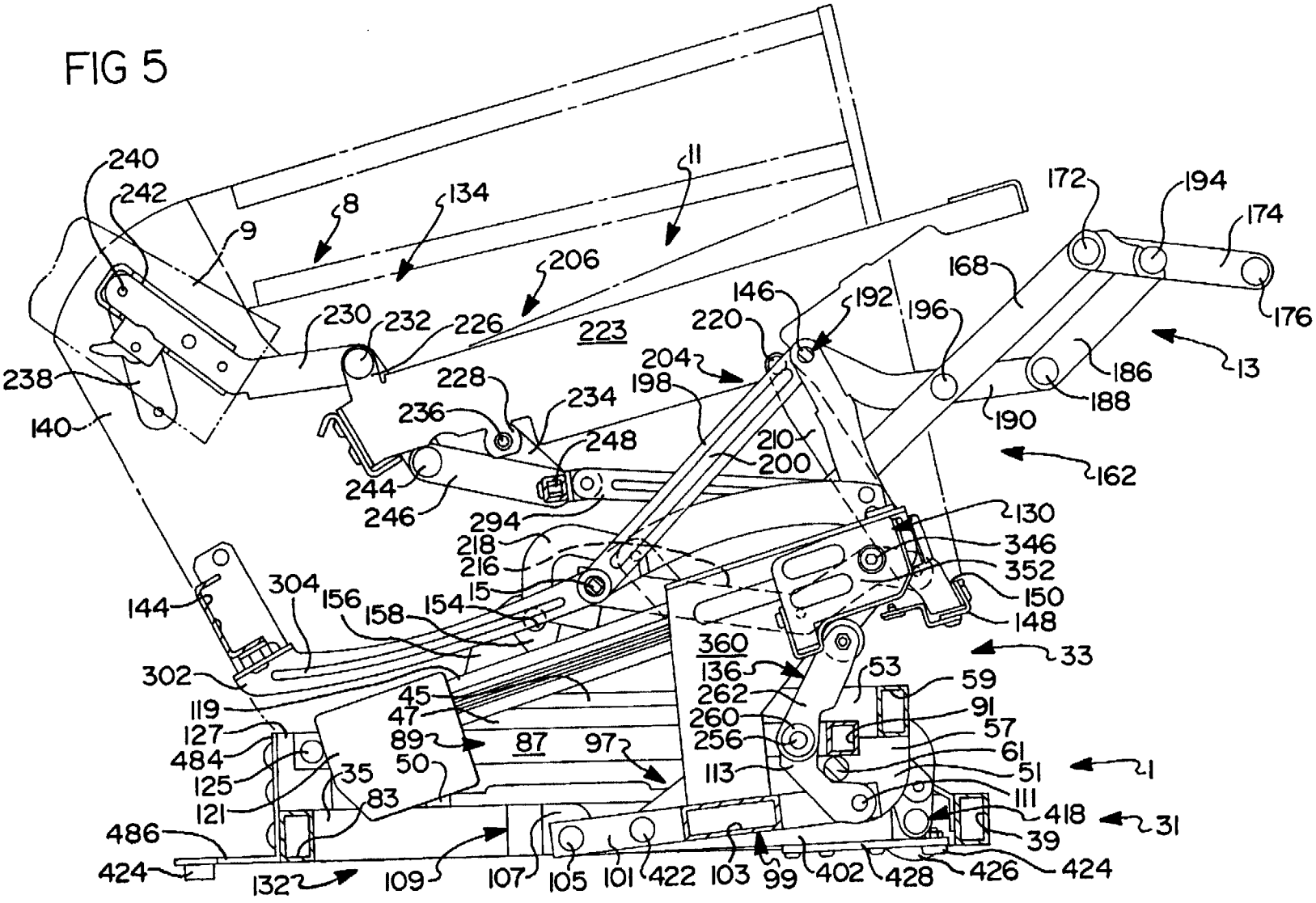
FIG. 5 is a side view taken through the power-assisted chair shown in FIG. 1D for illustrating the operative position of the reclining linkage assembly and full extension of the leg rest linkage assembly.

With reference to FIG. 4, link 174 is pivotally secured about a pivot 176 to a link 178 which, in turn, is pivotally secured about a pivot 180 to the front portion of a mounting bracket 182, one of which is mounted near each lateral end of leg rest panel 160. A pivot 184 secures one end of link 186 to the rear portion of mounting bracket 182 while its opposite end is pivotally secured about a pivot 188 to a link 190 which, in turn, is pivotally secured to top support rod 146 of chair frame 5 about a pivot 192. In addition, link 186 is also secured to an intermediate portion of link 174 by a pivot 194, while long drive link 168 is joined to link 190 by a pivot 196. Referring further to FIG. 10, a pair of brace or "spacing" links 198 having a central strengthening rib 200 are pivotally secured at one end to top support rod 146 at pivot 192 and are journally connected at the opposite end to square drive shaft 15. Additional support is provided to drive shaft 15 by a pair of laterally spaced rear drive shaft supports 302 having strengthening ribs 304. The rear end of each drive shaft support 302 is secured to the lower flange of rear cross member 144 via a suitable fastener. The opposite end of each drive shaft support 302 is journally connected to square drive shaft 15. Yet another means of reinforcement is provided by a pair of laterally spaced front drive shaft supports 306 journally connected to square drive shaft 15 at a rear end, and rigidly secured to a middle portion of corresponding front support arms 308. Each front support arm 308 is journally connected to top support rod 146 at its top end and rigidly secured to front cross rail 148 via fasteners 310. The same fasteners are used to attach a pair of stops 312 to front cross rail 148. Each stop 312 has a lower flange to which a foot 314 is secured. When chair frame 5 is in a lowered, unreclined position, or in a lifted and tilted position, stops 312 and more particularly feet 314 engage rectangular tube 59 thereby relieving drive shaft 15 of additional deforming forces. In operation, brace links 198, rear drive shaft supports 302, and front drive shaft supports 306 prevent any substantial deforming of square drive shaft 15 during operation of cam guide 130 when leg rest assembly 13 is being actuated. As best illustrated in FIGS. 3 through 5, this is accomplished by the two "A" shaped structures formed by brace links 198, front support arms 308, and front drive shaft supports 306 in combination with a rear drive shaft supports 302 which fully support drive shaft 15 during its rotation in both the up and down, and front and rear directions.

With particular reference to FIGS. 3 through 5, reclining linkage assembly 134 is shown which is operable for causing reclining angular movement between seat frame 11 and seat back 9. In general, reclining linkage assembly 134 includes a pair of laterally-spaced front tilt control assemblies 204 for changing the rearward pitch of chair frame 5 and a pair of laterally-spaced rear swing linkages 206 for controlling seatback 9. More particularly, each tilt control assembly 204 includes a lift link 210, the upper end of which is pivotally secured about pivot 220 to each seat bracket 212 which are secured to seat frame 11. The opposite end of lift link 210 is pivotally connected at pivot 214 to a lower end of lift lever 216. An intermediate portion of lift lever 216 is pivotally secured to a pivot bracket 208 at pivot 209. Pivot bracket 208 is attached to a forward upper surface of side rail 45 of upper frame member 33. Pivot bracket 208 has two separate pivot points formed therein for which pivot 209 may be selectively secured such that the initial pitch of chair frame 5 may be selected during assembly. The upper end of lift lever 216 is pivotally connected to one end of J-shaped toggle link 218 at pivot 217, with the opposite end of J-shaped toggle link 218 being pivotably connected to a smaller L-shaped bracket 221 (FIG. 10), which is secured for rotation with square drive rod 15. In operation, the interaction between the various links associated with tilt control assembly 204 causes rearward tilting of chair frame 5 about pivots 154 relative to lift base assembly 1 upon extension of leg rest assembly 13. More particularly, upon drive shaft 15 being rotatably driven in a counterclockwise direction, J-shaped toggle link 218 causes lift lever 21 6 to pivot on pivot bracket 208. The lower end of lift lever 216 rotates in an upward direction which causes lift link 210 to drive (or tilt) the front of chair frame 5 upwardly and rearwardly approximately 7° about pivot 154. Rotation of lift lever 216 stops when leg rest assembly 13 is fully extended. Continued reclining movement of seat back 9 and seat frame 11 drives seat bracket 21 2 forward which causes lift link 210 to pivot forwardly about lower pivot 214 thereby continuing to drive the front of chair frame 5 upwardly and rearwardly about pivots 154 an additional 3° (approximately). Tilt control assembly 204 is designed such that the first change in pitch of chair frame 5 (approximately 7°) occurs uniformly as the leg rest assembly 13 is extended. However, pivot 214 has been located such that the second change in pitch of chair frame 5 (approximately 3°) occurs early in the reclining cycle. Thus, the occupant may rearwardly tilt the chair into a more supportive position while maintaining the seatback in a substantially upright position. It should be apparent to one skilled in the art that the amount of tilt provided by tilt control assembly 204 is not limited by the approximate angles of tilt discussed above, and that the linkage of tilt control assembly 204 may be selectively altered to achieve variations in the aforementioned tilt angles.

As previously noted, reclining linkage assembly 134 also includes a pair of rear swing linkages 206 secured to each of seat frame side rails 222 near the rear end thereof. The rear portion of each seat frame side rails 222 has a rear seat bracket 224 with an upwardly extending rear portion 226 and a downwardly extending forward portion 228. An S-shaped link 230 is pivotally secured about a pivot 232 to upstanding rear portion 226 and a link 234 is pivotally secured about a pivot 236 to downwardly extending forward portion 228, the structure being generally similar to that illustrated and described in the above-mentioned U.S. Pat. No. 3,588,170.

An arm link 238 (FIG. 5) is secured to frame side members 140 of chair frame 5 by screws, rivets or any other reliable securing means. In addition, the upper ends of S-shaped links 230 are pivotably secured to arm links 238 about pivot 240 such that when slide brackets 242 secured to back frame 9 are slidably mounted on the upper end of S-shaped links 230, seat back 9 is pivotably movable relative to frame side members 140. With this arrangement, seat back frame 9 is supported for forward and rearward reclining movement within chair frame 5. The lower end of S-shaped link 230 is pivotally secured about a pivot 244 to an offset link 246, the opposite end of which is coupled to a tubular crossbar 248 and to which the opposite end of link 234 is pivotally secured. It is to be understood that similar linkages 234 and 246 associated with the opposite lateral side of seat frame 9 are likewise secured to the opposite end of crossbar 248. A spring member 250 is attached between an underside surface of side frames 222 of seat frame 11 and rear cross member 144 of chair frame 5 for normally biasing rear swing linkage 206 toward the upright position (FIG. 3).

As previously disclosed, seat frame 11, and more particularly side frames 222, are made of wood. However, as best illustrated in FIG. 5, seat frame 11 can be made out of metal having metal side frames 223. In this alternative preferred embodiment, rear seat brackets 224 are eliminated by integrally forming upwardly extending rear portion 226 and downwardly extending forward portion 228 into metal side frames 223. Additionally, seat brackets 212 are also eliminated because the upper end of lift link 210 is pivotally coupled directly to metal side frame 223 by pivot 220. Thus, the metal seat frame provides substantially the same function as the wooden seat frame while also providing a seating surface which is approximately 2 inches lower than that of the wooden seat frame.

Referring further to FIGS. 3–5 and 11, in accordance with a preferred construction of multi-function power-assisted chair 3, lift and tilt mechanism 97 includes L-shaped pivot brackets 360 that are located on opposite sides of motor housing 119 and rigidly secured to a top surface of cross piece 103 of lower lift bar member 99. Moreover, L-shaped pivot brackets 360 are laterally spaced to permit cam guide 130 to move linearly (fore and aft) therebetween and are each formed to include a set of aligned elongated slots 254 (FIGS. 3 and 4).

Referring to FIGS. 11 and 5, a rigid cross rail 362 is secured across the tops of L-shaped pivot brackets 360 for maintaining the lateral spacing therebetween. A rigid torque tube 256 (FIG. 5) is provided which extends transversely between side legs 87 of U-shaped upper tilt bar member 89. Torque tube 256 is located in close proximity to front cross piece 91 for defining the pivot point about which the upper ends of reinforcement brackets 113 are pivotally secured. Each guide pin 346 (FIG. 11 ) extends through non-threaded bore 374 from the outboard side of each of the cam blocks 352 and 356, through slots 254 in L-shaped pivot brackets 360, and into threaded bore 348 of cam guide 130. Upon securing each guide pin 346 into cam guide 130, the head 347 of guide pin 346 is located in a recess 392 formed in the outside lateral edge of each cam block 352 and 356. Preferably, a non-threaded metal insert 366, which could be made of brass or another similar metal, is molded into the outside lateral edge of each cam block 352 and 356 for engaging and distributing the force created by guide pin 346. As previously described, shaft 129 drives cam guide 130 such that cam guide 130 moves forwardly or rearwardly along shaft 129 upon rotation thereof in response to selective energization of motor 121.

As will be appreciated, and with particular reference to FIG. 3, when chair 3 is in the "normal" seating (i.e., lowered and upright) position, cam guide 130 is located approximately half way along shaft 129, leaving guide pins 346 of cam guide 130 positioned at the rear portion of slots 254. Lifting and tilting of chair 3 is accomplished by selectively energizing motor 121 to rotate shaft 129 in a first direction for drawing cam guide 130 rearwardly toward motor 121. Following a slight amount of initial rotation of shaft 129, guide pins 346 of cam guide 130 engage the rearward end stop surfaces of slots 254 such that continued rotation of shaft 129 causes lower lift bar member 99 to pivot upwardly about pivots 105 for moving chair frame 5 to the raised and forwardly tilted position shown in FIG. 4. Rotation of shaft 129 in the opposite or second direction returns chair 3 from the lifted and forwardly tilted position of FIG. 4 to the lowered upright position of FIG. 3.

Another unique feature of the present invention encompasses elimination of a "power pinch" condition upon a foreign object or resistances encountered by upper frame member 33 as it is lowered. More particularly, the mechanical interaction of cam guide 130 with lift and tilt mechanism 97 is such that guide pins 346 are free to move forwardly in slots 254 when an obstruction is encountered upon lowering chair frame 5 thus eliminating the "power pinch" condition.

With particular reference now to FIGS. 4, 5 and 8, means are provided for selectively actuating leg rest assembly 13 and reclining linkage assembly 134 upon selective continued rotation of shaft 129 in the second direction. In general, leg rest follower assembly 136 and recliner follower assembly 138 are concentrically mounted for independent pivotable movement on torque tube 256. Leg rest follower assembly 136 is adapted to rotate drive shaft 15 for causing power-assisted actuation of leg rest pantograph linkages 162. Likewise, recliner follower assembly 138 is adapted to drive (i.e., "pull") crossbar 248 (FIGS. 4 and 5) for causing power-assisted actuation of reclining linkage assembly 134. Leg rest follower assembly 136 is shown to include a first tubular sleeve 260 concentrically supported on torque tube 256 and on which is secured a first cam lever 262 and a first cam link 320 (FIG. 8). First cam lever 262 and first cam link 320 are rigidly secured to first tubular sleeve 260 such as by welding and a spacer bar 266 is provided therebetween for supplying additional rigidity. Attached to an upper end of first cam lever 262 is a follower member, such as roller 268, that is adapted to rollingly engage a first cam surface 354 (FIG. 11 ) formed on an underside surface of leg rest cam block 352. Rollers 268 and 291 are preferably made from steel or other hardened metal or durable plaster material such as nylon.

With further reference to FIG. 8, first cam link 320 is pivotally connected at its upper end to a first end of toggle link 274, the opposite end of which is connected to a drive link 276. Drive link 276 is coupled to drive shaft 15 for rotation therewith. As such, leg rest follower assembly 136 is designed to interact with first cam surface 354 (FIG. 11 ) of leg rest cam block 352 for selectively actuating leg rest pantograph linkages 162 by causing rotation of drive shaft 15. More particularly, as cam guide 130 extends forwardly along shaft 129, first cam surface 354 engages first roller 268 such that first cam link 320 is forwardly pivoted on torque tube 256 to cause a corresponding amount of angular movement of drive shaft 15 which, in turn, causes pantograph linkages 162 to extend.

With further reference to FIGS. 2–5, a pair of laterally-spaced springs 280 are provided which interconnect each pantograph linkage 162 to a bracket 282 rigidly supported from rear cross member 144 for normally biasing leg rest assembly 13 toward its retracted or "stored" position. Thus, once first cam surface 354 disengages first roller 268 upon rotation of shaft 129 (and retraction of cam guide 130), springs 280 act to forcibly urge leg rest assembly 13 to return to its "stored" position which, in turn, causes a corresponding amount of angular movement of drive shaft 15. As such, since leg rest follower assembly 136 is coupled for rotation with drive shaft 15, springs 280 are further adapted to bias leg rest follower assembly 136 toward the non-engaged positions shown in FIG. 3.

With reference now to FIGS. 2–5 and 8, and as noted, recliner follower assembly 138 is also installed concentrically about torque tube 256 and includes a second cam lever 284, a second tubular sleeve 286 (shown in FIG. 2), a second cam link 288 and a second spacer bar 290 (FIG. 8). A second roller 291 is supported from second cam lever 284 and is adapted to rollingly engage a second cam surface 358, shown in FIG. 12C, which is formed on the underside surface of recliner cam block 356. Second cam surface 358 is located sufficiently rearward on recliner cam block 356 relative to first cam surface 354 on leg rest cam block 352 to permit full extension of leg rest assembly 13 prior to initiation of any reclining movement. This orientation of first cam surface 354 relative to second cam surface 358 is clearly illustrated in FIGS. 12A and 12C.

With further reference to FIGS. 2–5, the upper end of second cam link 288 is pivotally attached to a connector link 294 provided for connecting second cam link 288 to tubular cross bar 248. As such, second cam surface 358 (FIG. 12C) acts on second roller 291 (FIG. 8) of recliner follower assembly 138 for moving cross bar 248 forwardly in response to such forward movement of cam guide 130. As will be appreciated, movement of cross bar 248 causes corresponding movement of reclining linkage assembly 134 for moving chair 3 to the fully "reclined" position of FIG. 5. In addition, one end of a spring link 296 (FIGS. 4 and 8) is interconnected to second cam link 288 with its other end secured to one end of a spring member 298. The other end of spring member 298 is supported from a bracket 300 (not shown) that is rigidly secured to rear cross member 144. Thus, spring member 298 is provided for urging second cam link 288 and, in turn, recliner follower assembly 138 rearwardly so as to bias reclining linkage 134 and, in turn, seat assembly 8 toward the "upright" position. Therefore, recliner follower assembly 138 is also adapted to provide a spring-biased return mechanism.

In operation, when a hand-operated control device (not shown) is selectively operated by the seat occupant to energize motor 121 for rotating shaft 129 in the first direction, chair 3 moves from the "normal" position shown in FIG. 1A to the forward "lifted" position shown in FIG. 1B. More particularly, rotation in the first direction causes cam guide 130 to move rearwardly toward motor 121 such that guide pins 346 engage the rear stop surfaces of slots 254 for pivoting lift and tilt mechanism 97 in the manner heretofore described. In addition, referring to FIGS. 3–5 and 6A, control link 420 of lift arm linkage 400, connected to lower lift bar member 99 of lift and tilt mechanism 97 at pivot 422, is urged toward the rear portion of lower frame member 31 as the lower lift bar member 99 is raised, and forces a toggle link 412 to rotate about pivot 41 6. The rotation of toggle link 412 further applies a downward force to a lift arm tube 402 through a connecting link 408, rotating lift arm tube 402 arcuately downward about pivot 105. As lift arm tube 402 rotates downward, glide 424 of extension plate 428 engages a floor surface, thereby vertically raising front cross member 39 and thus front wheel 426 off the floor. When front cross member 39 is in a raised position, chair 3 is prevented from moving across the floor on front wheels 426. It will be apparent to one skilled in the art that lift arm linkage assembly 400 can readily be modified to raise the chair frame to a variety of predetermined heights by varying the link sizing of the lift arm linkage assembly 400. As is apparent, selective rotation of shaft 129 in the second opposite direction causes chair 3 to be lowered to the normal seating position of FIG. 1A. Accordingly, as lift bar 99 of lift and tilt mechanism 97 lowers chair 3 into a normal seating position, lift arm tube 402 is rotated about pivot 105 in an opposite direction, thereby returning lower frame member 31 to its normal horizontal position in which front cross member 39 is thereby lowered and front wheel 426 engages the floor. Once lift arm tube 402 is fully retracted, chair 3 is free to move along front wheels 426 provided rear casters 482 remain unlocked.

With particular reference now to FIGS. 8 and 9, the leg rest follower assembly is shown which is identified by reference number 136. In general, the construction of leg rest follower assembly 136 provides an adjustment means for permitting the fully extended leg rest position to be simply and accurately set (i.e., "calibrated") during final assembly of chair 3, and which virtually eliminates problems inherent with conventional linkage tolerance stack-ups. In addition, the adjustment means is also highly desirable in that in-service re-calibration of the extended position for leg rest 13 can be quickly accomplished without the requirement of replacing or reworking any linkages.

With specific reference to FIG. 8, the adjustment means associated with modified leg rest follower assembly 136 generally includes a two-piece first cam link 320 having a fixed member 322 secured to first tubular sleeve 260 and an adjustable member 324 pivotably coupled to a first end of toggle link 274. Fixed member 322 has an elongated leg portion 326 that is adapted to be slidably disposed within an open-channel portion of adjustable member 324. More specifically, the open channel of adjustable member 324 is defined by a planar segment 328 and a pair of laterally-spaced and transversely extending edge flanges 330 which are adapted to retain leg portion 326 of fixed member 322 therein. An elongated slot 332 is formed in planar segment 328 of adjustable member 324 and is adapted to be adjustably alignable with a bore 334 formed in leg portion 326 of fixed member 322. A suitable fastener, such as a threaded bolt 336, is adapted to extend through bore 334 and slot 332 and is releasably retained therein by a suitable locking member, such as nut 338. To provide additional rigidity, drive link 276 has a square tubular sleeve 340 fixed (i.e., welded) thereto that is aligned with a square aperture (not shown) formed in drive link 276 and through which drive shaft 15 extends. A pair of set screws 344 are retained within threaded bores formed through tubular sleeve 340 and which are adapted to lockingly engage an outer surface of drive shaft 15 for fixing the orientation of drive link 276 relative to drive shaft 15.

During final assembly of chair 3, the second end of toggle link 274 is coupled to drive link 276. Thereafter, adjustable member 324 is slidably inserted over fixed member 322 such that leg portion 326 is retained between end flanges 330 and against planar segment 328. Next, leg rest follower assembly 136 is pivoted forwardly to rotate drive shaft 15 until pantograph linkages 162 are adequately extended for positioning leg rest frame board 160 at the desired elevated position. Following this calibration step, threaded bolt 336 is inserted through the aligned bore 334 and slot 332, and nut 338 is sufficiently tightened thereon to releasably secure adjustable member 324 to leg portion 326 of fixed member 322. Thus, this arrangement eliminates the inherent problems encountered with typical tolerance stack-ups between the various links of pantograph linkages 162 as well as potential inaccuracies in the initial angular relationship between drive shaft 15 and first roller 268. Moreover, such an arrangement facilitates easy in-service re-calibration of the elevated position of frame board 160 by simply re-adjusting the relationship between fixed member 322 and adjustable member 324. Moreover, such in-service re-calibration, which may be necessitated due to sagging of frame board 160 from worn pivotal connections between the various moving linkages, can be accomplished without the requirement of disassembling chair 3 and replacing pantograph linkages 162.

With particular reference now to FIGS. 2 and 11, the linear actuation drive mechanism is shown and identified by reference numeral 132. In general, linear actuation drive mechanism 132 is operable for selectively actuating reclining linkage assembly 134, leg rest assembly 13, reclining tilt assembly 65 and lift and tilt mechanism 97 utilizing the single electric motor 121, and the shaft 129 which rotates to retract and extend cam guide 130 along motor housing 119. Moreover, the cam guide 130 has teeth on opposing sides (not shown) which engage threads formed in shaft 129 such that cam guide 130 moves forwardly or rearwardly (i.e., "fore and aft") upon rotation of shaft 129 in one of the first or second directions. As previously disclosed, rotation of shaft 129 in the first direction results in linear movement of cam guide 130 toward motor 121 while rotation in the second direction results in linear movement of cam guide 130 away from motor 121. As previously noted, the rotational movement of shaft 129 can be controlled by selectively energizing motor 121 via a hand-held control device (not shown).

With continued reference to FIGS. 2, 11, and 12A through 12D, leg rest cam block 352 is shown to be pivotably fixed to one side of cam guide 130 by threaded guide pin 346. With particular reference to FIG. 11, leg rest cam block 352 is further shown to include a first cam wear plate 378 which runs along the lower surface of leg rest cam block 352 (FIG. 12A), thereby forming first cam surface 354 on an underside surface thereof that is adapted for engagement with first roller 268 of leg rest follower assembly 136. First cam wear plate 378 is secured to the front and rear surfaces of leg rest cam block 352 by screws 376 (FIG. 12A). First cam wear plate 378 includes a leg rest cam stop 394 which is further reinforced by gusset 398. Similarly, recliner cam block 356 is shown to be pivotably fixed to the opposite side of cam guide 130 by threaded guide pin 346 and has second cam wear plate 380 which runs along the lower surface of recliner cam block 356 (FIG. 12C), thereby forming second cam surface 358 on an underside surface thereof which is adapted for engagement with second roller 291 of recliner follower assembly 138. Second cam wear plate 380 is secured to the front and rear surfaces of recliner cam block 356 by screws 376 (FIG. 12C). Second cam wear plate 380 includes a recliner cam stop 396 which is further reinforced by gusset 398. Thus, forward linear movement of cam guide 130 along shaft 129 is operable for causing leg rest cam block 352 to engage and pivotably displace leg rest follower assembly 136 for actuating leg rest assembly 13 in a manner substantially identical to that disclosed above. Furthermore, continued forward linear movement of cam guide 130 along shaft 129 is adapted to cause recliner cam block 356 to engage second roller 291 and pivotably displace recliner follower assembly 138 for actuating recliner linkage 134 in a substantially identical manner to that disclosed above. As will be appreciated, the cam surfaces formed on leg rest cam block 352 and recliner cam block 356 are associated such that the leg rest assembly 13 may be fully extended before movement of recliner linkage assembly 134 begins. While not critical to the operation of linear actuation drive mechanism 132, it is preferable that both leg rest cam block 352 and recliner cam block 356 be fabricated from a rigid plastic material such as, for example, nylon or the like. It is desirable to add first and second cam wear plates 378 and 380 to each cam block 352 and 356 respectively, to prevent excessive loads created by the cam follower assemblies from damaging the engaging surface of the cam blocks. Cam wear plates 378 and 380 are preferably made of, but not limited to, a durable material such as steel.

As will again be appreciated, the use of a single power-assisted drive system, such as linear actuation drive mechanism 132, provides a simple yet effective means for selectively lifting and tilting chair 3 (via lift and tilt mechanism 97), extending and retracting leg rest assembly 13 (via leg rest follower assembly 136), changing the pitch of chair frame 5 (via tilt control assembly 204), and angularly moving seat back 9 and seat 11 of seat assembly 8 between an "upright" and a "reclined" position (via recliner follower assembly 138). In addition, due to the pivotable interconnection between each cam block and cam guide 130, bending or deforming loads exerted by cam guide 130 on shaft 129 during linear movement thereof are significantly minimized. Moreover, the use of separate cam blocks 352 and 356 provides a simple arrangement for manufacturing various combinations of power-assisted chairs 3 by using one or both of leg rest cam block 352 and recliner cam block 356. Furthermore, in-service repair or replacement of one of the cam blocks or cam block wear plates can be accomplished without removing motor assembly 121 because cam guide 130 need not be removed from shaft 129.

According to the construction shown in FIGS. 2 and 11, lift and tilt mechanism 97 includes laterally-spaced L-shaped pivot brackets 360 that are located on opposite sides of shaft 129 and rigidly secured to a top surface of cross piece 103 of lower lift bar member 99. L-shaped pivot brackets 360 are laterally spaced to permit and guide the linear movement (fore and aft) of cam guide 130 therebetween and are formed to each include an elongated slot 254. In addition, rigid cross rail 362 is secured between a forward end of pivot brackets 360 for maintaining the lateral spacing therebetween. As noted, leg rest cam block 352 is pivotably secured to one lateral side of cam guide 130 while recliner cam block 356 is pivotably secured to the other lateral side thereof. As will be described, both cam blocks are adapted to move linearly in concert with cam guide 130 upon rotation of shaft 129 in response to selective actuation of motor 121. In operation, first cam surface 354 of leg rest cam block 352 is engageable with first roller 268 of leg rest follower assembly 136 for causing corresponding angular movement of drive shaft 15 which, in turn, results in a corresponding amount of extensible movement of leg rest pantograph linkages 162. Similarly, second cam surface 358 of recliner cam block 356 is engageable with second roller 291 of recliner follower assembly 138 for causing corresponding movement of reclining linkage 134 and, in turn, a corresponding amount of "reclining" movement of seat assembly 8.

As best seen from FIG. 11, leg rest cam block 352 is positioned adjacent an outer lateral surface of one of L-shaped pivot brackets 360 and is pivotably aligned with the corresponding lateral edge of cam guide 130 via guide pin 346. More specifically, guide pin 346 extends through a non-threaded bore 364 formed through leg rest cam block 352 and is secured into a threaded bore on cam guide 130, thereby maintaining alignment of leg rest cam block 352 with cam guide 130. Preferably, leg rest cam block 352 is journally supported for pivotable movement on a non-threaded portion 368 of guide pin 346. Moreover, an outwardly extending transverse flange segment 370 formed at the uppermost portion of pivot bracket 360 is adapted to be slidably engageable with an upper planar surface 372 of leg rest cam block 352 so as to limit pivotable movement thereof during linear movement. In addition, flange segment 370 is also adapted to maintain alignment of leg rest cam block 352 upon linear movement thereof and particularly upon engagement with first roller 268 of leg rest follower assembly 136.

Similarly, recliners cam block 356 is positioned adjacent an outer lateral surface of the other one of L-shaped pivot brackets 360 and is pivotably aligned with the corresponding lateral edge of cam guide 130 via a second guide pin 346. Guide pin 346 extends through a non-threaded bore 374 formed through recliner cam block 356 and is secured into a threaded bore on cam guide 130, thereby maintaining alignment of recliner cam block 356 with cam guide 130. Again, it is preferred that recliner cam block 356 be journally supported for pivotable movement on a non-threaded portion 368 of guide pin 346. Moreover, the outwardly extending transverse flange segment 370 formed on the pivot bracket 360 located adjacent to recliner cam block 356 is likewise adapted to be slidably engageable with an upper planar surface 382 of recliner cam block 356 for maintaining alignment as well as guiding linear movement thereof.

As will be appreciated, when chair 3 is in the "normal" seating (i.e., lowered and upright) position of FIG. 1A and 3, cam guide 130 is positioned near the rear portion of slots 254 of L-shaped pivot brackets 360. Lifting and tilting of chair is accomplished by selectively energizing motor 121 via the hand-operated control device (not shown) to rotate shaft 129 in the first direction for drawing cam guide 130 rearwardly toward motor 121. Following a slight amount of initial rearward movement of cam guide 130, guide pins 346 engage the rearward end stop surfaces of slots 254 in pivot brackets 360 such that continued rearward movement of cam guide 130 in the first direction causes lower lift bar member 99 to pivot upwardly about pivots 105 for moving chair frame 5 to the raised and forwardly tilted or "lifted" position shown in FIGS. 1B and 4. Again, subsequent rotation of shaft 129 in the opposite or second direction will return chair 3 from the lifted and upwardly tilted position of FIG. 4 to the lowered position of FIG. 3.

In accordance with the teachings of the present invention, with chair 3 in the normal seated position of FIGS. 1A and 3, rotation of shaft 129 in the second direction causes forward ,movement of cam guide 130 and, in turn, cam blocks 352 and 356 relative to shaft 129. Thus, guide pin 346 moves forwardly through slots 254 until first cam surface 354 of leg rest cam block 352 engages first roller 268 on first cam lever 262 of leg rest follower assembly 136. Continued forward movement of cam guide 130 acts to pivotably drive leg rest follower assembly 136 about torque tube 256 such that cam link 320 drives toggle link 274 which, in turn, drives connector link 276 for rotating drive shaft 15. In this manner, pantograph leg rest linkages 162 may be protracted to their fully extended position of FIGS. 1C and 5.

To inhibit undesirable up/down bending of shaft 129 in response to engagement of leg rest cam block 352 with leg rest follower assembly 136, leg rest cam block 352 is pivotably moveable about guide pin 346 relative to cam guide 130 for maintaining sliding engagement between its top surface 372 and flange segment 370 of pivot bracket 360. As such, the loading transferred from leg rest cam block 352 to cam guide 130 and ultimately to shaft 129 is significantly reduced. The pivotable relationship between recliner cam block 356 and cam guide 130 is likewise adapted to minimize the loading ultimately transferred to shaft 129 in a similar fashion. As noted, leg rest cam block 352 and recliner cam block 356 are preferably made of a low-friction material such as, without limitation, nylon or the like which promotes smooth sliding movement thereof upon engagement with flange segments 370. In order to provide further stability first and second gusset members, 386 and 388, respectively, are welded to the lower portion of pivot brackets 360. Gussets 386 and 388 prevent side deflection of pivot brackets 360, and therefore, prevent side-to-side deflection of shaft 129.

As seen from FIGS. 11 and 12A through 12D, adjacent first cam surface 354 is a generally planar surface 384 formed on first cam wear plate 378 upon which first roller 268 continues to ride during continued forward movement of cam guide 130 following complete extension of leg rest assembly 13. This planar surface 384 permits continued forward movement of leg rest cam block 352 without generating any additional rotation of drive shaft 15. Additionally, leg rest cam stop 394 formed on first cam wear plate 378 serves to prevent first roller 268 from overrunning planar surface 384. In operation, leg rest assembly 13 can be returned to its retracted position by simply reversing the direction of shaft 129 for moving cam guide 130 and leg rest cam block 352 rearwardly so as to permit spring members 280 to forcibly urge leg rest follower assembly 136 to rotate rearwardly and, in turn, cause concurrent rotation of drive shaft 15. As noted, such spring-biased return means generates a significantly reduced return force as compared to systems having a power return feature while concurrently eliminating the occurrence of "power pinch" conditions.

During engagement of first roller 268 with cam surface 354, second roller 291 rides on a forward planar surface 390 located adjacent cam surface 358, both formed on second cam wear plate 380, which permits a predetermined amount of forward linear movement of recliner cam block 356 without generating pivotable movement of recliner follower assembly 138. However, following full extension of leg rest assembly 13 in the manner described, continued forward movement of cam guide 130 causes engagement between second cam surface 358 of recliner cam block 356 and second roller 291 of recliner follower assembly 138. Such engagement acts to forwardly pivot second cam link 288 about second tubular sleeve 286 which, in turn, forwardly drives (i.e. pulls) tubular cross bar 248 via connector link 294 for concurrently actuating rear swing linkage 206 and front swing linkage 204, whereby chair 3 is moved toward the "reclined" position of FIG. 1D. Additionally, recliner cam stop 396 formed on second cam wear plate 380 serves to prevent second roller 291 from overrunning second cam surface 358. Preferably, a slight amount of linear displacement of cam guide 130 along shaft 129 is provided between the end of the point of contact of first roller 268 with cam surface 354 and the beginning of contact of second roller 291 with second cam surface 358 such that the seat occupant may fully extend leg rest assembly 13 without initiating reclining movement.

Motor 121 and cam guide 130 are very similar in positioning to those which are clearly illustrated and described in U.S. patent application Ser. No. 08/154,977 commonly owned by the assignee of the present invention, the specification and drawings of which are expressly incorporated by reference herein.

As will be appreciated, the preferred embodiments of the present invention can be easily modified to include one or both of the leg rest and recliner follower assemblies 136 and 138, respectively. As shown, actuation is sequential when both follower assemblies are utilized. As such, it is possible to manufacture various combination recliner chairs 3 by simply eliminating one of the respective follower assemblies, rendering one of the follower assemblies inoperative, or eliminating one of the separate cam blocks. Furthermore, linear actuation drive mechanism 132 is adapted for simple installation into conventional manually actuated drive systems without a significant number of new parts or design changes being required.

Chair 3 is especially useful for invalids since by pressing switches on the hand-operated control device the seat occupant can change his position on the seat to provide greater comfort when desired. If the disability of the occupant is such as to render the occupant unable to reach switches mounted on the side of chair 3, it is within the purview of the invention to provide a switch box which may rest on the occupant's lap and be operated by the simple movement of a finger. The advantages of the DC powered actuation motor allow the use of an electrical switch box supplied with significantly lower voltage which reduces the chance of an electrical shock from injuring the occupant. Additionally the DC motor may be provided with a low cost onboard battery system, which allows the seat occupant to utilize the motorized functions of the lift and tilt chair when an AC electrical outlet is unavailable.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A power-assist chair comprising:

a base assembly;

a chair frame pivotally supported on said base assembly;

a rotatable drive shaft extending transversely between opposite side portions of said chair frame;

a leg rest assembly supported from said chair frame and operatively coupled to said drive shaft for movement from a retracted position to an extended position in response to rotation of said drive shaft in a first direction;

a seat assembly having a seat member, a seat back and swing link means for pivotally interconnecting said seat back and said seat member to said chair frame for reclining movement between an upright position and a reclined position;

lift means operatively interconnecting said chair frame to said base assembly for elevating and tilting said chair frame;

actuation means for actuating said lift means, said actuation means including a driven member, and power operated means for causing movement of said driven member; and a tilt control assembly operably coupling said chair frame to said base assembly for providing tilting movement therebetween, said tilt control assembly including a pivot assembly for pivotally coupling said chair frame to said base assembly; a lift link pivotally connected at an upper end to said seat member and pivotally interconnected at a lower end to said drive shaft; and a lift lever having a first end pivotally connected to said lower end of said lift link, and a second end operably coupled to said drive shaft, said lift lever further being pivotally connected to said pivot assembly such that rotation of said lift lever in response to movement of said drive shaft urges said lift link upwardly to tilt said chair frame with respect to said base assembly.

2. The power assist chair of claim 1 wherein said tilt control assembly is operably coupled and selectively movable in response to movement of said actuation means.

3. The power assist chair of claim 1 wherein said tilt control assembly is selectively movable in response to movement of said actuation means for causing tilting movement of said chair frame with respect to said base assembly.

4. The power-assist chair of claim 1 having a lift arm member operably coupled to said base assembly, said lift arm member causing a vertical displacement of a front portion of said chair frame in response to said actuation means.

5. The power-assist chair of claim 4 wherein said lift means and said lift arm member are operatively associated with said actuation means such that continued movement of said driven member rearwardly away from a neutral position actuates said lift means to move said chair frame to an elevated-tilted position, and moves said lift arm member away from said base assembly causing said vertical displacement of said chair frame, and wherein subsequent movement of said driven member forwardly toward said neutral position acts to lower said chair frame from said elevated-tilted position to a normal lowered seating position, and moves said lift arm member toward said base assembly thereby lowering said front portion of said chair frame.

6. The power-assist chair of claim 1 further including wheel means coupled to said base assembly, said wheel means including a pair of wheels attached to a front portion of said base assembly, and a pair of casters attached to a rear portion of said base assembly by a bracket member.

7. The power-assist chair of claim 6 wherein said casters are lockable to prevent undesired movement of said base assembly of said chair along a support surface.

8. The power-assist chair of claim 1 wherein said power operated means comprises an electric motor and a screw shaft rotatably driven by said motor, and wherein said driven member has internal threads received on said screw shaft such that selective energization of said motor causes said screw shaft to rotate in a first direction for causing movement of said driven member in a forward direction, and wherein said motor may be energized for generating rotation of said screw shaft in an opposite second direction for causing movement of said driven member in a rearward direction.

9. The power-assist chair of claim 8, wherein said actuation means further includes:

first follower means supported for pivotal movement on said base assembly and operably interconnected to said drive shaft, and second follower means supported for pivotal movement on said base assembly and operably interconnected to said swing link means, said actuation means for selectively actuating said swing link means and said leg rest assembly;

a first cam block supported for movement on said driven member and adapted to engage said first follower means in response to movement of said driven member for causing pivotable movement thereof which results in corresponding rotation of said drive shaft in said second direction for extending said leg rest assembly;

a second cam block supported for movement on said driven member and adapted to engage said second follower means in response to movement of said driven member for causing pivotable movement thereof which results in corresponding movement of said swing link means for moving said seat assembly to said reclined position; and spring return means for biasing-said first and second follower means, such that said leg rest assembly is normally biased toward said retracted position and said seat assembly is normally biased toward said upright position.

10. The power-assist chair of claim 9 wherein said leg rest assembly includes pantograph linkage means operatively connected to said drive shaft such that rotation of said drive shaft moves said leg rest assembly and movement of said leg rest assembly moves said drive shaft.

11. The power-assist chair of claim 10 wherein said swing link means includes a pair of swing linkages supported on opposite rear side portions of said chair frame and interconnecting said seat assembly to said chair frame, said pair of swing linkages interconnected by a transverse cross member which is operatively coupled to said second follower means for moving said pair of swing linkages forwardly upon said second cam block engaging and pivotably moving said second follower means.

12. The power-assist chair of claim 1 wherein rotation of said lift lever in response to rotation of said drive shaft urges said lift link upwardly for imparting a first tilt angle to said chair frame with respect to said base assembly, and forward rotation of said lift link about a pivot with said lift lever in response to continued movement of said linear actuation means urges said seat member upwardly for imparting a second tilt angle to said chair frame with respect to said base assembly.

13. The power-assist chair of claim 1 wherein said first tilt angle is approximately 7 degrees, and said second tilt angle is approximately 3 degrees.

14. A power-assist chair comprising:

a base assembly;

a chair frame pivotally supported on said base assembly;

a rotatable drive shaft extending transversely between opposite side portions of said chair frame;

a leg rest assembly supported from said chair frame and operatively coupled to said drive shaft for movement from a retracted position to an extended position in response to rotation of said drive shaft in a first direction;

a seat assembly having a seat member, a seat back and swing link means for pivotally interconnecting said seat back and said seat member to said chair frame for reclining movement between an upright position and a reclined position;

lift means operatively interconnecting said chair frame to said base assembly for elevating and tilting said chair frame;

linear actuation means for actuating said lift means, said linear actuation means including a driven member, and power-operated means for causing movement of said driven member;

a tilt control assembly operably coupling said chair frame to said base assembly for providing tilting movement therebetween, said tilt control assembly including a pivot assembly pivotally coupling said chair frame to said base assembly, a rearwardly canting lift link pivotally connected at an upper end to a seat bracket of said seat member; a lift lever having a forward end pivotally coupled to a lower end of said lift link and a rearward end operably coupled to said drive shaft, said lift lever further being pivotally connected to said pivot assembly such that rotation of said lift lever in response to rotation of said drive shaft urges said lift link upwardly for imparting a first tilt angle to said chair frame with respect to said base assembly, and forward rotation of said lift link about a pivot with said lift lever in response to continue movement of said linear actuation means urges said seat member upwardly for imparting a second tilt angle to said chair frame with respect to said base assembly;

a lift arm member coupled for pivotable movement on said base assembly, said lift arm member operatively associated with said linear actuation means and said lift means for causing vertical displacement of a front portion of said base assembly in response to said linear actuation means; and wheel means coupled to said base assembly, said wheel means including a pair of wheels attached to a front portion of said base assembly, and a pair of casters attached to a rear portion of said base assembly by a universal bracket member.

15. The power-assist chair of claim 14 wherein said tilt control assembly is selectively movable in response to movement of said linear actuation means to urge said front portion of said chair frame in an upward direction to rotate said chair frame about said pivot assembly, thereby tilting said chair frame with respect to said base assembly.

16. The power-assist chair of claim 14 wherein said lift arm member further includes a lift arm linkage assembly having a connecting linkage interconnecting a forward portion of said lift arm member with said base assembly, and said lift arm linkage assembly having a control link operatively interconnecting said lift arm member with said lift means.

17. The power-assist chair of claim 16 wherein said lift means and said lift arm member are operatively associated with said linear actuation means such that continued movement of said driven member rearwardly away from a neutral position actuates said lift means to move said chair frame to an elevated-tilted position, and causes said lift arms to rotate about a pivot pin in a downward direction causing vertical displacement of said base assembly, and wherein subsequent movement of said driven member forwardly toward said neutral position acts to lower said chair frame from said elevated-tilted position to a normal lowered seating position, and causes said lift arms to rotate about pivot pin in an upward direction, thereby lowering said front portion of said base assembly.

18. The power-assist chair of claim 14 wherein said casters are lockable to prevent undesired movement of said base assembly of said chair along a support surface.

19. The power-assist chair of claim 14 wherein said driven member includes a first cam block and a second cam block having a cam surface formed thereon by a metal cam wear plate having an engaging end, a running surface, and a cam stop formed at an end opposite said engaging end for preventing said follower means from overrunning said cam blocks, said cam stop further including a reinforcing gusset secured therein for providing structural support to said cam stop.

20. The power-assist chair of claim 14 wherein said power-operated means comprises an electric motor and a screw shaft rotatably driven by said motor, and wherein said driven member has internal threads received on said screw shaft such that selective energization of said motor causes said screw shaft to rotate in a first direction for causing movement of said driven member in a forward direction, and wherein said motor may be energized for generating rotation of said screw shaft in the opposite second direction for causing movement of said driven member in a rearward direction.

21. The power-assist chair of claim 20 wherein said electric motor is a DC motor, and wherein said DC motor may be operated by a rechargeable power supply, said rechargeable power supply being self-contained within the power-assist chair.

22. The power-assist .chair of claim 14 wherein said leg rest assembly reaches a fully extended position prior to commencing movement of said seat assembly from said upright position toward said reclined position.

23. The power-assist chair of claim 14 wherein said rotatable drive shaft is supported by a tripartite spacing link assembly.

24. The power-assist chair of claim 14 wherein said first tilt angle is approximately 7 degrees, and said second tilt angle is approximately 3 degrees.

25. A power-assist chair comprising:

a base assembly;

a chair frame pivotally supported on said base assembly;

a rotatable drive shaft extending transversely between opposite side portions of said chair frame;

a leg rest assembly supported from said chair frame and operatively coupled to said drive shaft for movement from a retracted position to an extended position in response to rotation of said drive shaft in a first direction;

a seat assembly having a seat member, a seat back and swing link means for pivotally interconnecting said seat back and said seat member to said chair frame for reclining movement between an upright position and a reclined position;

lift means operatively interconnecting said chair frame to said base assembly for elevating and tilting said chair frame;

linear actuation means for actuating said lift means, said linear actuation means including a driven member, and power-operated means for causing movement of said driven member;

said driven member including a first cam block and a second cam block having a cam surface formed thereon by a metal cam wear plate having an engaging end, a running surface, and a cam stop formed at an end opposite said engaging end for preventing said follower means from overrunning said cam blocks, said cam stop further including a reinforcing gusset secured therein for providing structural support to said cam stop;

a tilt control assembly operably coupling said chair frame to said base assembly for providing tilting movement therebetween, said tilt control assembly including a pivot assembly pivotally coupling said chair frame to said base assembly, and a tilt control linkage interconnected between said base assembly and a front portion of said chair frame;

a lift arm member coupled for pivotable movement on said base assembly, said lift arm member operatively associated with said linear actuation means and said lift means for causing vertical displacement of a front portion of said base assembly in response to said linear actuation means; and wheel means coupled to said base assembly, said wheel means including a pair of wheels attached to a front portion of said base assembly, and a pair of casters attached to a rear portion of said base assembly by a universal bracket member.

* * * * *

UNITED STATES PATENT AND TRADEMARK OFFICE

CERTIFICATE OF CORRECTION

PATENT NO. : 5,730,494

DATED : March 24, 1998

INVENTOR(S) : Larry P. LaPointe, et al.

It is certified that error appears in the above-indentified patent and that said Letters Patent is hereby corrected as shown below:

Column 3, line 55, 56;
"illustrating the operative position of the reclining linkage assembly and" should be --illustrates the various link members associated with the chair--;

Column 4, line 3;

"therefor" should be --the--;

Column 5, line 51;
"1 01" should be --101--.

Column 5, line 56;
"1 01" should be --101--.

Column 6, line 23;
"41 8" should be --418--.

Column 6, line 27;
"1 01" should be --101--.

UNITED STATES PATENT AND TRADEMARK OFFICE

CERTIFICATE OF CORRECTION

PATENT NO. : 5,730,494

DATED : March 24, 1998

INVENTOR(S) : Larry P. LaPointe, et al.

It is certified that error appears in the above-indentified patent and that said Letters Patent is hereby corrected as shown below:

Column 6, line 35;
"I" should be --1--.

Column 7, line 44;
"mils" should be --rails--.

Column 10, line 26;
"21 6" should be --216--.

Column 10, line 33;
"21 2" should be --212--.

Column 12, line 44;
"plaster" should be --plastic--.

Column 13, line 57;
"41 6" should be --416--.

UNITED STATES PATENT AND TRADEMARK OFFICE

CERTIFICATE OF CORRECTION

PATENT NO. : 5,730,494

DATED : March 24, 1998

INVENTOR(S) : Larry P. LaPointe, et al.

It is certified that error appears in the above-indentified patent and that said Letters Patent is hereby corrected as shown below:

Column 17, line 12;
"recliners" should be --recliner--.

Column 17, line 49;
",movement" should be --movement--.

Column 21, line 6, Claim 9;

"biasing-said" should be --biasing said--.

Column 23, line 11, Claim 22;

".chair" should be --chair--.

Signed and Sealed this

Twenty-seventh Day of October, 1998

*Attest:*

Bruce Lehman

BRUCE LEHMAN

*Attesting Officer*

*Commissioner of Patents and Trademarks*